US010760521B2

(12) United States Patent
Okamura

(10) Patent No.: US 10,760,521 B2
(45) Date of Patent: Sep. 1, 2020

(54) CONTROL DEVICE AND CONTROL METHOD FOR FUEL PUMP

(71) Applicant: TOYOTA JIDOSHA KABUSHIKI KAISHA, Toyota-shi, Aichi-ken (JP)

(72) Inventor: Seiji Okamura, Toyota (JP)

(73) Assignee: TOYOTA JIDOSHA KABUSHIKI KAISHA, Toyota (JP)

( * ) Notice: Subject to any disclaimer, the term of this patent is extended or adjusted under 35 U.S.C. 154(b) by 0 days.

(21) Appl. No.: 16/207,576

(22) Filed: Dec. 3, 2018

(65) Prior Publication Data

US 2019/0178197 A1 Jun. 13, 2019

(30) Foreign Application Priority Data

Dec. 13, 2017 (JP) ..... 2017-238767

(51) Int. Cl.

| | |
|---|---|
| ***F02D 41/38*** | (2006.01) |
| ***F02M 59/20*** | (2006.01) |
| ***F02M 59/10*** | (2006.01) |
| ***F02M 39/02*** | (2006.01) |
| ***F02M 63/00*** | (2006.01) |
| ***F02D 41/30*** | (2006.01) |
| *F02D 41/40* | (2006.01) |

(52) U.S. Cl.

CPC ..... *F02D 41/3845* (2013.01); *F02D 41/3082* (2013.01); *F02M 39/02* (2013.01); *F02M 59/10* (2013.01); *F02M 59/20* (2013.01); *F02M 63/0017* (2013.01); *F02D 41/401* (2013.01); *F02D 41/402* (2013.01); *F02D 2200/0602* (2013.01)

(58) Field of Classification Search

CPC ..... F02D 41/3845; F02D 41/3082; F02D 41/401; F02D 41/402; F02D 41/009; F02D 2200/0602; F02D 2200/503; F02B 17/06; F02M 59/20; F02M 59/10; F02M 51/04; F02M 39/02; F02M 63/0017

See application file for complete search history.

(56) References Cited

U.S. PATENT DOCUMENTS

2004/0154594 A1* 8/2004 Miyashita ..... F02D 33/003 123/458

2009/0217910 A1 9/2009 Alessandri et al.

(Continued)

FOREIGN PATENT DOCUMENTS

JP 2003-120452 A 4/2003

*Primary Examiner* — George C Jin

(74) *Attorney, Agent, or Firm* — Oliff PLC

(57) ABSTRACT

A control device for a motor-driven fuel pump adapted for an internal combustion engine is provided. The fuel pump includes a cylinder, a mover in the cylinder, and an electric actuator configured to move the mover. The control device is configured to perform energization control on the electric actuator to reciprocate the mover so that the fuel pump draws in and discharges fuel. The control device is also configured to control a discharge count and a unit discharge amount based on an operating state of the internal combustion engine. The discharge count is a number of times of discharging fuel from the fuel pump to the fuel pipe during a period between a fuel injection from the fuel injection valve and the next fuel injection, and the unit discharge amount is an amount of fuel for one fuel discharge from the fuel pump.

10 Claims, 10 Drawing Sheets

(56) References Cited

U.S. PATENT DOCUMENTS

2014/0034017 A1* 2/2014 Omae ..... F02M 59/368
123/456
2016/0131074 A1* 5/2016 Nakano ..... F02D 41/20
137/2

* cited by examiner

CONTROL DEVICE AND CONTROL METHOD FOR FUEL PUMP

BACKGROUND

The present disclosure relates to a control device and a control method for a fuel pump.

An internal combustion engine disclosed in US Patent Application Publication No. 2009/0217910 includes a fuel injection valve for injecting fuel into a cylinder, a fuel pipe connected to the fuel injection valve, and a fuel pump for supplying the fuel to the fuel pipe. The fuel pump includes a plunger disposed in the cylinder. The plunger is made of a magnetic material. The plunger is constantly biased in a first direction by a biasing spring provided in the fuel pump. The fuel pump includes a coil for exciting the plunger. When the coil is energized, the plunger is excited by a magnetic field generated around the coil. When the plunger is energized, the plunger moves in a second direction opposite to the first direction against the biasing force of the biasing spring. When energization to the coil is stopped, excitation of the plunger is cancelled and the plunger moves in the first direction according to the biasing force of the biasing spring. In this manner, in the fuel pump, the plunger reciprocates in the cylinder. Each time the plunger reciprocates, the fuel pump executes a suction operation for drawing in fuel and a discharge operation for pressurizing and discharging the drawn fuel.

In the control device of the fuel pump described in the above publication, when the fuel injection amount from the fuel injection valve is within a predetermined range, the driving cycle of the fuel injection valve and the driving cycle of the fuel pump are set to be the same. Therefore, one fuel discharge from the fuel pump is performed in response to one fuel injection from the fuel injection valve. With this configuration, in order to allow a sufficient amount of fuel to be supplied to the fuel pipe with respect to the fuel injection amount from the fuel injection valve, it is necessary to design the fuel pump so that the maximum amount of fuel that can be discharged from the fuel pump is increased.

On the other hand, there is a demand for downsizing the fuel pump as downsizing of the internal combustion engine is desired. However, with a small-sized fuel pump, the maximum amount of fuel that can be discharged from the fuel pump at one time is small. Accordingly, when the control device described in the above publication is adapted for such a small-sized fuel pump, the amount of fuel discharged from the fuel pump at one time is insufficient for one fuel injection amount from the fuel injection valve, which may not be able to supply a sufficient amount of fuel to the fuel pipe. Therefore, there is room for improving the controllability of the fuel pressure in the fuel pipe.

SUMMARY

In accordance with one aspect of the present disclosure, a control device for a fuel pump is provided. The fuel pump is a motor-driven fuel pump adapted for an internal combustion engine. The internal combustion engine includes a fuel injection valve configured to inject fuel into a cylinder. The fuel pump is configured to supply fuel to a fuel pipe connected to the fuel injection valve. The fuel pump includes a cylinder, a mover configured to slide in the cylinder, and an electric actuator configured to move the mover. The control device includes processing circuitry that is configured to: perform energization control on the electric actuator to reciprocate the mover so that the fuel pump draws in and discharges fuel; and control a discharge count and a unit discharge amount based on an operating state of the internal combustion engine, the discharge count being a number of times of discharging fuel from the fuel pump to the fuel pipe during a period between a fuel injection from the fuel injection valve and the next fuel injection, and the unit discharge amount being an amount of fuel for one fuel discharge from the fuel pump.

In accordance with another aspect of the present disclosure, a control method for a fuel pump is provided. The fuel pump is a motor-driven fuel pump adapted for an internal combustion engine. The internal combustion engine includes a fuel injection valve configured to inject fuel into a cylinder. The fuel pump is configured to supply fuel to a fuel pipe connected to the fuel injection valve. The fuel pump includes a cylinder, a mover configured to slide in the cylinder, and an electric actuator configured to move the mover. The control method includes: performing energization control on the electric actuator to reciprocate the mover so that the fuel pump draws in and discharges fuel; and controlling a discharge count and a unit discharge amount based on an operating state of the internal combustion engine, the discharge count being a number of times of discharging fuel from the fuel pump to the fuel pipe during a period between a fuel injection from the fuel injection valve and the next fuel injection, and the unit discharge amount being an amount of fuel for one fuel discharge from the fuel pump.

Other aspects and advantages of the present disclosure will become apparent from the following description, taken in conjunction with the accompanying drawings, illustrating by way of example the principles of the disclosure.

BRIEF DESCRIPTION OF THE DRAWINGS

The disclosure, together with objects and advantages thereof, may best be understood by reference to the following description of the presently preferred embodiments together with the accompanying drawings in which.

DETAILED DESCRIPTION

First Embodiment

A control device for a fuel pump according to a first embodiment will now be described with reference to FIGS. 1 to 6.

Figure 1:
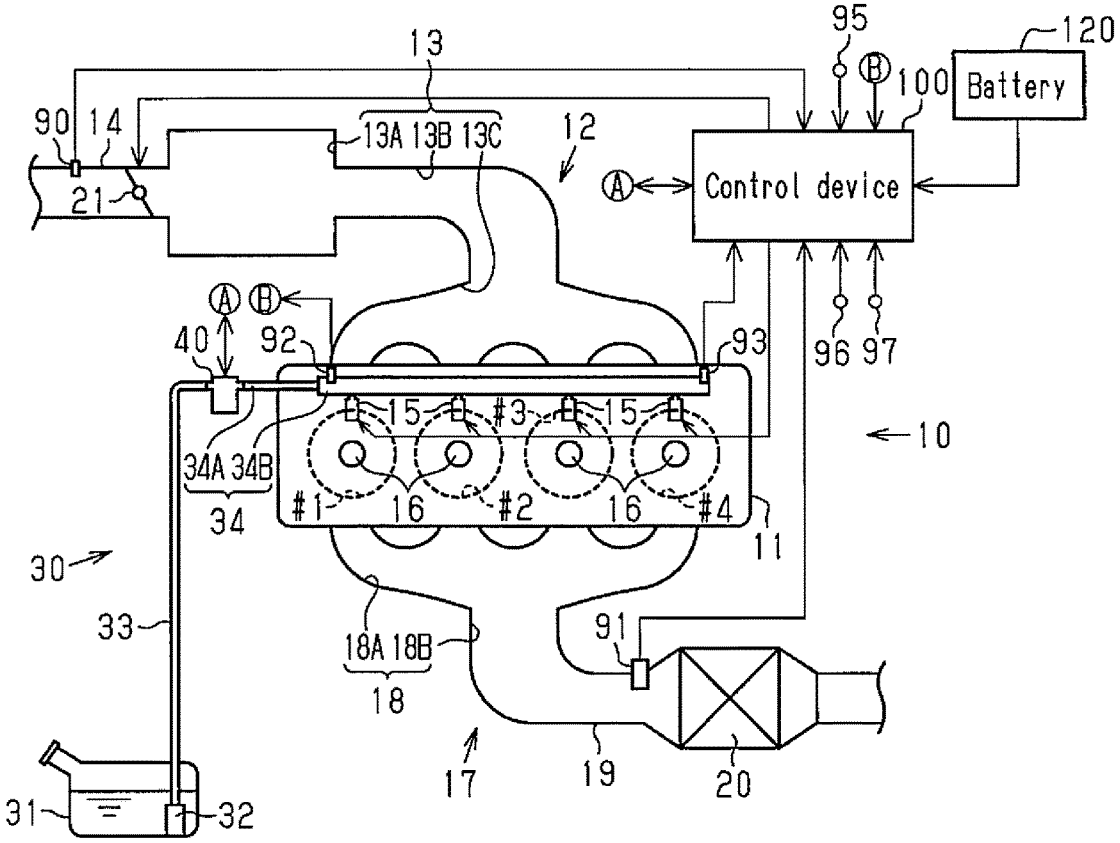
FIG. 1 is a schematic diagram showing a configuration of an internal combustion engine including a control device for a fuel pump according to a first embodiment.

As shown in FIG. 1, an engine main body 11 of an internal combustion engine 10 mounted on a vehicle includes four cylinders (a first cylinder #1 to a fourth cylinder #4). To the engine main body 11, an intake passage 12 is connected. The intake passage 12 includes an intake manifold 13 and an intake pipe 14 connected to the end of the intake manifold 13 on the intake upstream side. The intake manifold 13 includes a surge tank 13A connected to the intake pipe 14, an intake introduction section 13B provided on the intake downstream side of the surge tank 13A, and an intake branching section 13C provided on the intake downstream side of the intake introduction section 13B. The surge tank 13A has a larger passage cross-sectional area than the intake pipe 14 and the intake introduction section 13B. The intake branching section 13C has four end portions branching on the intake downstream side, and the respective four branching end portions are connected to different cylinders. The intake pipe 14 is provided with a throttle valve 21. By controlling the opening degree of the throttle valve 21, the flow rate of the intake air flowing through the intake passage 12 is controlled. The air flowing from the intake pipe 14 to the intake manifold 13 is supplied to the respective cylinders #1 to #4. The intake pipe 14 is provided with an air flow meter 90 that detects the flow rate of the intake air flowing through the intake passage 12 on the intake upstream side with respect to the throttle valve 21.

The engine main body 11 is provided with a plurality of fuel injection valves 15. One fuel injection valve 15 is provided for each cylinder. The fuel injection valve 15 is disposed in the cylinder to inject fuel into the cylinder. In each of the cylinders #1 to #4, an ignition plug 16 is provided. In each of the cylinders #1 to #4, the intake air introduced through the intake passage 12 and the fuel injected from the fuel injection valve 15 are mixed to generate an air-fuel mixture. The mass ratio of intake air to fuel in the air-fuel mixture is referred to as air-fuel ratio. The air-fuel mixture is ignited by the ignition plug 16 and combusted.

To the engine main body 11, an exhaust passage 17 is connected. The exhaust passage 17 includes an exhaust manifold 18 and an exhaust pipe 19 connected to the end of the exhaust manifold 18 on the exhaust downstream side. The exhaust manifold 18 is composed of an exhaust branching section 18A connected to the engine main body 11 and an exhaust confluence section 18B provided on the exhaust downstream side of the exhaust branching section 18A. The exhaust branching section 18A has four branched ends on the exhaust upstream side, and the respective four branching end portions are connected to different cylinders. In each of the cylinders #1 to #4, exhaust gas generated by combustion of the air-fuel mixture is discharged to the exhaust manifold 18. In the exhaust passage 17, a catalyst 20 disposed in the exhaust pipe 19 to purify the exhaust gas is provided. Further, in the exhaust pipe 19, an air-fuel ratio sensor 91 is disposed on the exhaust upstream side of the catalyst 20. The air-fuel ratio sensor 91 outputs an electric signal corresponding to the oxygen concentration of the exhaust gas flowing through the exhaust passage 17, that is, the air-fuel ratio of the air-fuel mixture used for combustion.

The internal combustion engine 10 is provided with a fuel supply device 30 for supplying fuel to the fuel injection valve 15 provided in the engine main body 11. The fuel supply device 30 includes a fuel tank 31 in which fuel is stored. Inside the fuel tank 31, a low-pressure fuel pump 32 is disposed. To the low-pressure fuel pump 32, one end of a low-pressure fuel pipe 33 is connected. The low-pressure fuel pump 32 is a motor-driven fuel pump, pumps up the fuel in the fuel tank 31, and discharges the fuel to the low-pressure fuel pipe 33. To the other end of the low-pressure fuel pipe 33, a high-pressure fuel pump 40 is connected. To the high-pressure fuel pump 40, a high-pressure fuel pipe 34 is connected. The high-pressure fuel pipe 34 is composed of a discharge pipe 34A connected to the high-pressure fuel pump 40 and a delivery pipe 34B connected to the discharge pipe 34A. To the delivery pipe 34B, the respective fuel injection valves 15 are connected. The fuel discharged from the low-pressure fuel pump 32 to the low-pressure fuel pipe 33 is drawn into the high-pressure fuel pump 40. In the high-pressure fuel pump 40, the drawn fuel is pressurized and discharged to the discharge pipe 34A. The fuel discharged to the discharge pipe 34A is supplied to the delivery pipe 34B and injected into the cylinder from the fuel injection valve 15. In the delivery pipe 34B, a pressure sensor 92 is provided on a first end portion connected to the discharge pipe 34A. The pressure sensor 92 detects the fuel pressure Pr in the high-pressure fuel pipe 34. In the delivery pipe 34B, a fuel temperature sensor 93 is provided on a second end portion opposite to the first end portion. The fuel temperature sensor 93 detects the temperature of the fuel in the high-pressure fuel pipe 34.

Figure 2:
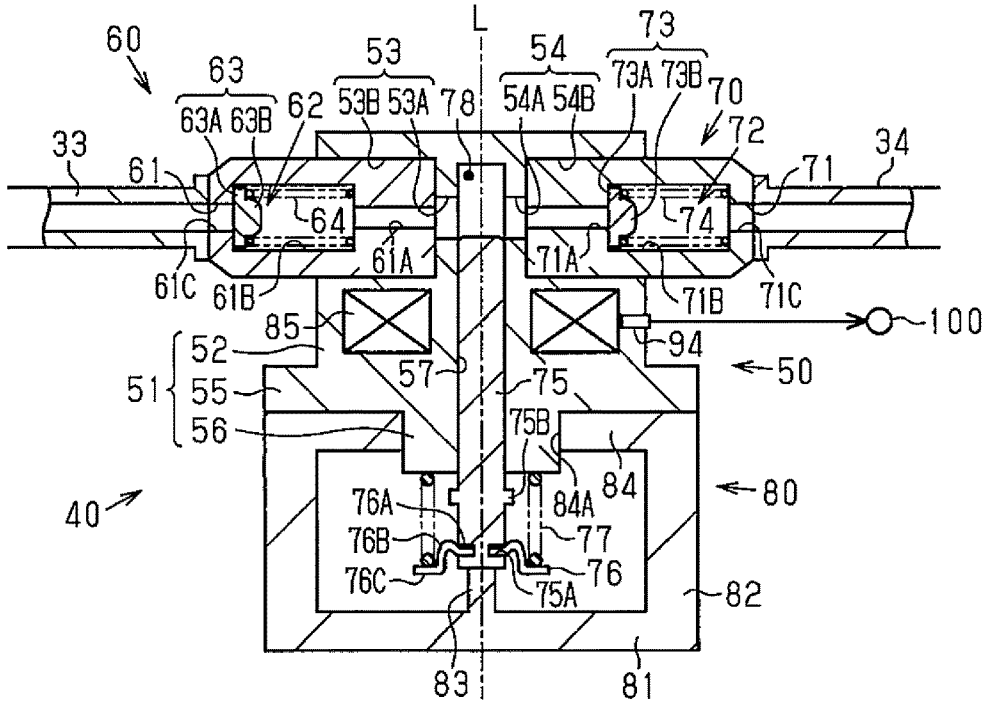
FIG. 2 is a cross-sectional view of the high-pressure fuel pump in FIG. 1.

As shown in FIG. 2, the high-pressure fuel pump 40 includes a pump section 50 that draws in and pressurizes fuel and a casing 80 to which the pump section 50 is connected.

The casing 80 has a box shape. The casing 80 has a lower wall 81 and an upper wall 84 that each have a disc shape, and a peripheral side wall 82 that extends from the circumferential edge of the lower wall 81 to the circumferential edge of the upper wall 84. At a central portion of the lower wall 81, a columnar protruded portion 83 that protrudes in the inner space side of the casing 80 is provided. The peripheral side wall 82 is continuously provided over the entire periphery of the circumferential edge of the lower wall 81 and the upper wall 84, and has a cylindrical shape. The upper wall 84 has a through hole 84A at a central portion.

The pump section 50 includes a housing 51 fixed to the upper end surface of the upper wall 84. The housing 51 is composed of a main body portion 52 having a cylindrical shape, a flange portion 55 disposed between the main body portion 52 and the upper wall 84, and an insertion portion 56 extending from the flange portion 55. The flange portion 55 has a larger diameter than the main body portion 52 and is in contact with the upper wall 84. The insertion portion 56 extends from the flange portion 55 to the inner space of the casing 80 through the through hole 84A. The outer diameter of the insertion portion 56 is the same as the inner diameter of the through hole 84A. Therefore, the outer circumferential surface of the insertion portion 56 is in contact with the inner circumferential surface of the through hole 84A of the upper wall 84. The housing 51 has a cylinder bore 57. The cylinder bore 57 extends from one end face (the lower end face in FIG. 2) of the insertion portion 56 to the inside of the main body portion 52. Hereinafter, the extending direction (the up-down direction in FIG. 2) of the central axis L of the cylinder bore 57 is simply referred to as the axial direction.

The main body portion 52 has a first orthogonal hole 53 and a second orthogonal hole 54 that extend in a direction (the left-right direction in FIG. 2) orthogonal to the axial direction and communicate with the cylinder bore 57. The first orthogonal hole 53 and the second orthogonal hole 54 extend in opposite directions from the cylinder bore 57. The first orthogonal hole 53 has a first small diameter portion 53A that communicates with the cylinder bore 57 and a first large diameter portion 53B that extends from the first small diameter portion 53A to the side peripheral surface of the main body portion 52 and opens on the side peripheral surface. In the first large diameter portion 53B, a suction valve 60 is inserted and fitted.

The suction valve 60 has a cylindrical shape and is attached to the main body portion 52 in a state of protruding from the main body portion 52. In the suction valve 60, a suction passage 61 extends through the suction valve 60 in the above-described orthogonal direction is formed. The suction passage 61 is composed of a first suction passage 61A that is connected to the first small diameter portion 53A, a second suction passage 61B that is connected to the first suction passage 61A and has a larger diameter than the first suction passage 61A, and a third suction passage 61C that is connected to the second suction passage 61B and has the same diameter as the first suction passage 61A. In the second suction passage 61B, a first check valve 62 is disposed. The first check valve 62 is composed of a first valve body 63 and a first spring 64 for biasing the first valve body 63 toward the third suction passage 61C. The first valve body 63 is composed of a first biasing portion 63A that is in contact with the inner end surface of the second suction passage 61B on which the third suction passage 61C opens, and a first bulging portion 63B that bulges from the central portion of the first biasing portion 63A toward the first suction passage 61A. The first bulging portion 63B has a hemispherical shape. The first spring 64 has a first end that is in contact with the inner end surface of the second suction passage 61B on which the first suction passage 61A opens, and a second end that is in contact with the first biasing portion 63A of the first valve body 63. To the suction valve 60, the low-pressure fuel pipe 33 is connected, and to the third suction passage 61C, fuel is supplied from the low-pressure fuel pipe 33.

The second orthogonal hole 54 has a second small diameter portion 54A that communicates with the cylinder bore 57 and a second large diameter portion 54B that extends from the second small diameter portion 54A to the side peripheral surface of the main body portion 52 and opens on the side peripheral surface. In the second large diameter portion 54B, a discharge valve 70 is inserted and fitted. The discharge valve 70 has a cylindrical shape and is attached to the main body portion 52 in a state of protruding from the main body portion 52. The discharge valve 70 and the suction valve 60 are arranged side by side on the same axis extending in the above-described orthogonal direction. In the discharge valve 70, a discharge passage 71 extending through the discharge valve 70 in the above-described orthogonal direction is formed. The discharge passage 71 is composed of a first discharge passage 71A that is connected to the second small diameter portion 54A, a second discharge passage 71B that is connected to the first discharge passage 71A and has a larger diameter than the first discharge passage 71A, and a third discharge passage 71C that is connected to the second discharge passage 71B and has the same diameter as the first discharge passage 71A. In the second discharge passage 71B, a second check valve 72 is disposed.

The second check valve 72 is composed of a second valve body 73 and a second spring 74 for biasing the second valve body 73 toward the first discharge passage 71A. The second valve body 73 is composed of a second biasing portion 73A that is in contact with the inner end surface of the second discharge passage 71B on which the first discharge passage 71A opens, and a second bulging portion 73B that bulges from the central portion of the second biasing portion 73A toward the third discharge passage 71C. The second bulging portion 73B has a hemispherical shape. The second spring 74 has a first end that is in contact with the inner end surface of the second discharge passage 71B on which the third discharge passage 71C opens, and a second end that is in contact with the second biasing portion 73A of the second valve body 73. To the discharge valve 70, the high-pressure fuel pipe 34 is connected.

The pump section 50 includes a plunger 75 serving as a mover that is inserted into the cylinder bore 57 and that is slidable in the cylinder bore 57. The plunger 75 is made of a magnetic material. The plunger 75 has a columnar rod shape and is inserted into the cylinder bore 57 from the lower end opening of the insertion portion 56. The lower end portion of the plunger 75 extends from the cylinder bore 57 to the inner space of the casing 80. The plunger 75 has a groove 75A at a lower end portion. The groove 75A extends over the entire circumference in the circumferential direction. Therefore, the plunger 75 has a diameter that is partially reduced at the position in which the groove 75A is formed. To the groove 75A, a pedestal 76 having an annular plate shape is connected. The pedestal 76 is composed of a central portion 76A engaged with the groove 75A, a curved portion 76B having a curve and extending outward in the radial direction from the central portion 76A, and a flat portion 76C extending outward in the radial direction from the curved portion 76B. Between the flat portion 76C and the insertion portion 56 of the housing 51, a compression spring 77 is disposed. The compression spring 77 biases the pedestal 76 in a direction away from the housing 51, that is, in a direction of pulling out the plunger 75 from the cylinder bore 57 (downward in FIG. 2). The lower end surface of the plunger 75 is pressed against the upper end surface of the protruded portion 83 of the casing 80 by the biasing force of the compression spring 77. The plunger 75 has a protrusion 75B at a lower end portion above the groove 75A. The protrusion 75B extends over the entire circumference in the circumferential direction. Therefore, the plunger 75 has a diameter that is partially increased at the position of the protrusion 75B. The diameter of the protrusion 75B is larger than the diameter of the cylinder bore 57. The cylinder bore 57, the plunger 75, the first small diameter portion 53A, the first suction passage 61A, the second suction passage 61B, the second small diameter portion 54A, and the first discharge passage 71A constitute a pressurizing chamber 78 of the pump section 50.

In the main body portion 52 of the housing 51, a coil 85 is disposed so as to surround the periphery of the cylinder bore 57. The coil 85 generates a magnetic field upon energization. When the coil 85 is energized, the plunger 75 is excited by the magnetic field generated around the coil 85.

Figure 3:
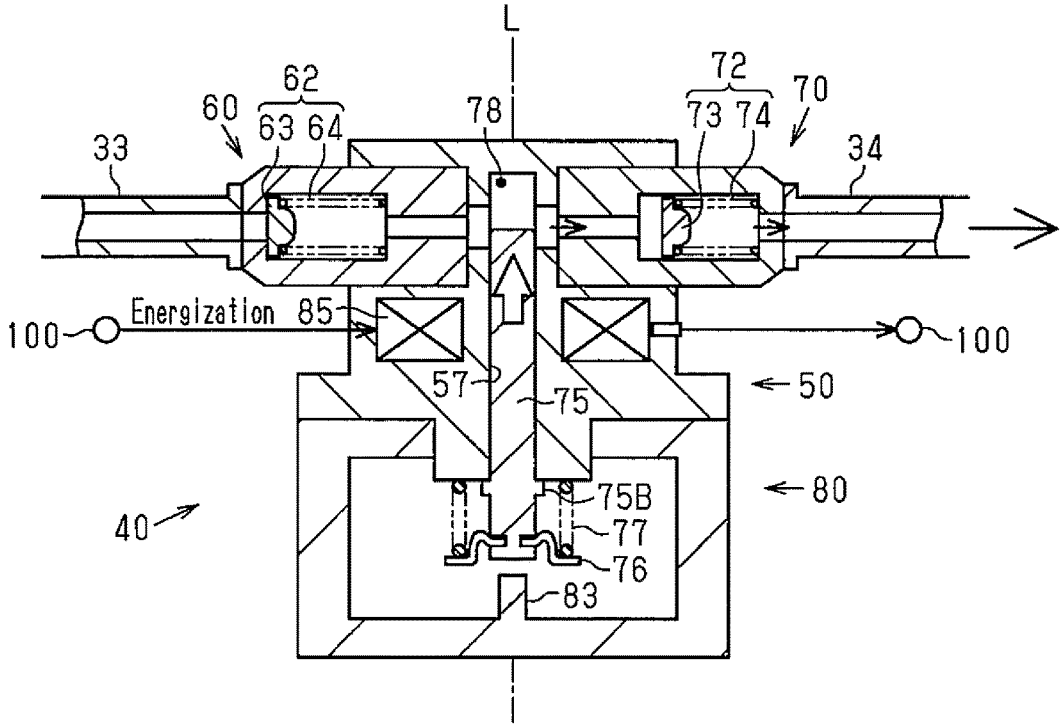
FIG. 3 is a cross-sectional view showing a state during fuel discharge in the high-pressure fuel pump in FIG. 2.

As indicated by the blank arrow in FIG. 3, when the plunger 75 is excited, the plunger 75 moves to a first side (the upper side in FIG. 3) in the axial direction against the biasing force of the compression spring 77. The plunger 75 moves to the first side until the protrusion 75B comes into contact with the insertion portion 56. This movement of the plunger 75 decreases the volume of the pressurizing chamber 78 of the pump section 50 and increases the pressure in the pressurizing chamber 78. Since the pressurizing chamber 78 is filled with fuel as described later, increasing the pressure of the pressurizing chamber 78 makes the discharge valve 70 open. Specifically, the second valve body 73 of the discharge valve 70 is subjected to the pressure in the pressurizing chamber 78 in the valve opening direction, and is also subjected to the pressure in the high-pressure fuel pipe 34 and the biasing force of the second spring 74 in the valve closing direction. When the pressure in the pressurizing chamber 78 increases and the force of biasing the second valve body 73 in the valve opening direction becomes higher than the force of biasing the second valve body 73 in the valve closing direction, the second valve body 73 is opened. When the second valve body 73 opens, fuel is discharged from the pressurizing chamber 78 to the high-pressure fuel pipe 34 as indicated by the solid line arrow in FIG. 3. While the fuel is discharged from the high-pressure fuel pump 40 to the high-pressure fuel pipe 34, the suction valve 60 is held in a closed state by the pressure in the pressurizing chamber 78. On the other hand, when the energization to the coil 85 is stopped, the excitation of the plunger 75 is cancelled.

Figure 4:
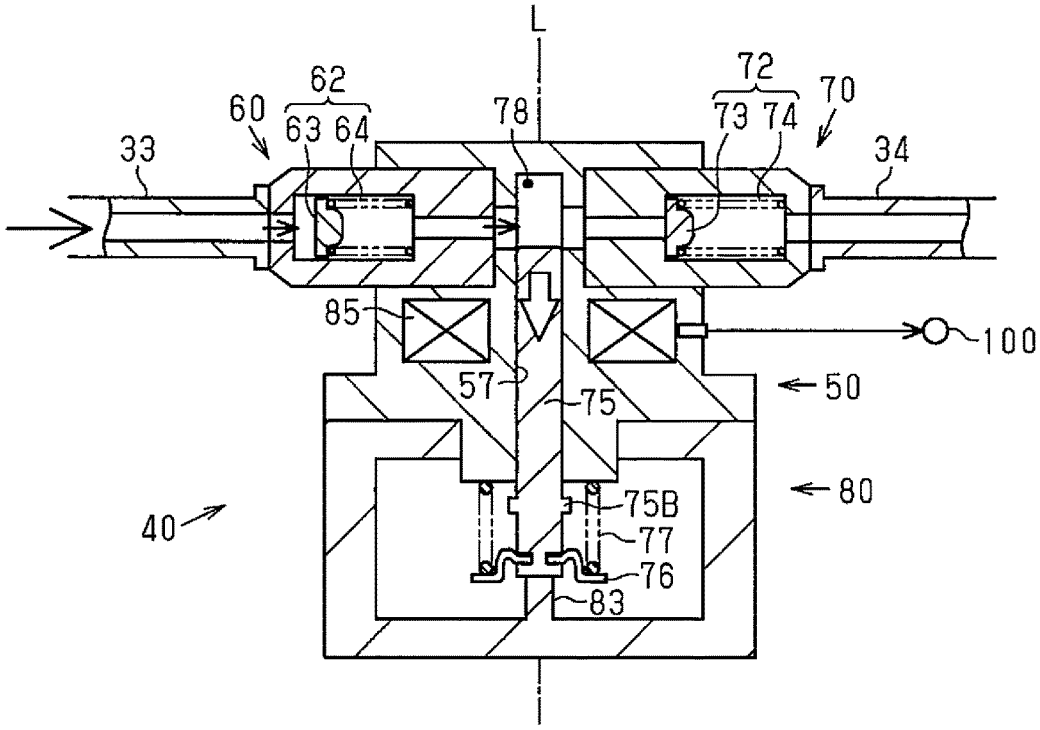
FIG. 4 is a cross-sectional view showing a state during fuel suction in the high-pressure fuel pump in FIG. 2.

As indicated by the blank arrow in FIG. 4, when the excitation of the plunger 75 is cancelled, the plunger 75 moves to a second side (the lower side in FIG. 4) in the axial direction by the biasing force of the compression spring 77 so that the plunger 75 is pulled out from the cylinder bore 57. The plunger 75 moves to the second side until its lower end comes into contact with the protruded portion 83. This movement of the plunger 75 increases the volume of the pressurizing chamber 78 and decreases the pressure in the pressurizing chamber 78. The first valve body 63 of the suction valve 60 is subjected to the pressure in the low-pressure fuel pipe 33 in the valve opening direction, and is also subjected to the pressure in the pressurizing chamber 78 and the biasing force of the first spring 64 in the valve closing direction. When the pressure in the pressurizing chamber 78 decreases and the force of biasing the first valve body 63 in the valve closing direction becomes lower than the force of biasing the first valve body 63 in the valve opening direction, the first valve body 63 is opened. When the first valve body 63 opens, fuel is supplied from the low-pressure fuel pipe 33 to the pressurizing chamber 78 as indicated by the solid line arrow in FIG. 4. While the high-pressure fuel pump 40 draws in the fuel from the low-pressure fuel pipe 33, the discharge valve 70 is held in a closed state by the pressure in the high-pressure fuel pipe 34.

In this manner, the plunger 75 reciprocates in the axial direction inside the cylinder bore 57 depending on the energization state of the coil 85. Accordingly, the coil 85 corresponds to an electric actuator for moving the plunger 75. Each time the plunger 75 reciprocates, the high-pressure fuel pump 40 performs a suction function of drawing in the fuel and a discharge function of pressurizing and discharging the drawn fuel. Further, in the main body portion 52 of the fuel pump, a coil temperature sensor 94 is provided. The coil temperature sensor 94 detects the temperature of the coil 85.

As shown in FIG. 1, the fuel supply device 30 includes a control device 100 for a fuel pump. Further, the internal combustion engine 10 includes a battery 120. The battery 120 supplies electric power to the respective parts of the internal combustion engine 10, such as the control device 100 and the electric actuator of the high-pressure fuel pump 40.

To the control device 100, output signals are input from the air flow meter 90, the air-fuel ratio sensor 91, the pressure sensor 92, the fuel temperature sensor 93, and the coil temperature sensor 94. To the control device 100, an output signal of a crank angle sensor 95 that detects the engine rotational speed NE, which is a rotational speed of a crankshaft of the internal combustion engine 10, and the crank angle CA, which is a rotation phase of the crankshaft is also input. Further, to the control device 100, output signals from various sensors such as an accelerator sensor 96 for detecting an accelerator operation amount Acc that is an operation amount of an accelerator pedal, a vehicle speed sensor 97 for detecting a vehicle speed V, etc., are also input. The control device 100 includes a CPU, a ROM, and a RAM. The control device 100 causes the CPU to execute programs stored in the ROM to control driving of the fuel injection valve 15, driving of the throttle valve 21, and driving of the high-pressure fuel pump 40.

Figure 5:
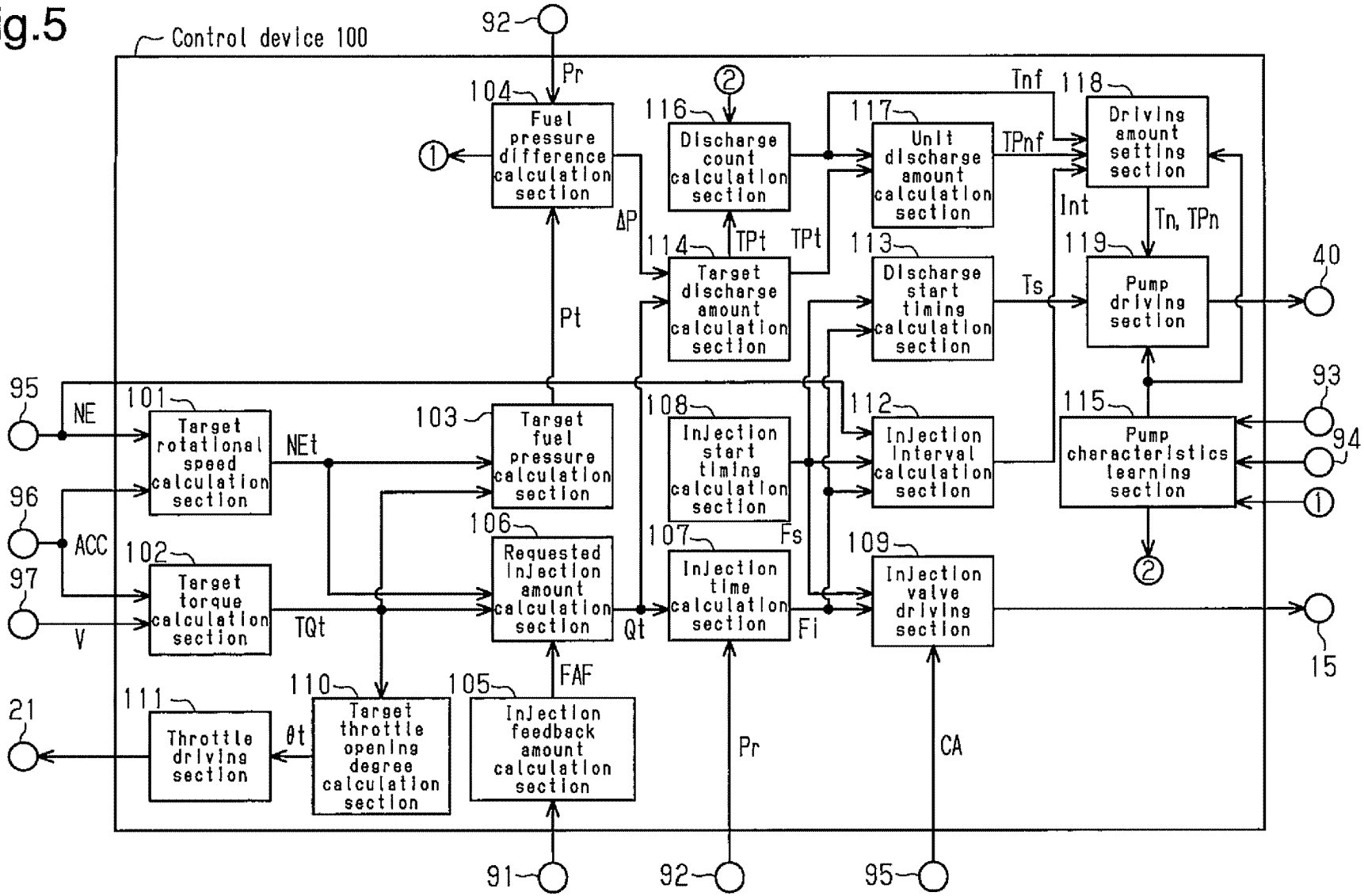
FIG. 5 is a functional block diagram of the control device in FIG. 1.

As shown in FIG. 5, the control device 100 includes, as functional sections, a target rotational speed calculation section 101, a target torque calculation section 102, a target fuel pressure calculation section 103, a fuel pressure difference calculation section 104, an injection feedback amount calculation section 105, a required injection amount calculation section 106, an injection time calculation section 107, an injection start timing calculation section 108, and an injection valve driving section 109. Further, the control device 100 includes a target throttle opening degree calculation section 110, a throttle driving section 111, an injection interval calculation section 112, a discharge start timing calculation section 113, a target discharge amount calculation section 114, a pump characteristics learning section 115, a discharge count calculation section 116, a unit discharge amount calculation section 117, a driving amount setting section 118, and a pump driving section 119.

The target rotational speed calculation section 101 calculates a target rotational speed NEt that is a target value of the engine rotational speed NE, based on the engine rotational speed NE detected by the crank angle sensor 95 and the accelerator operation amount Acc detected by the accelerator sensor 96.

The target torque calculation section 102 calculates a target torque TQt that is a target value of the axial torque of the crankshaft of the internal combustion engine 10, based on the vehicle speed V detected by the vehicle speed sensor 97 and the accelerator operation amount Acc detected by the accelerator sensor 96.

The target fuel pressure calculation section 103 calculates a target fuel pressure Pt that is a target value of the fuel pressure in the high-pressure fuel pipe 34, based on the target rotational speed NEt calculated by the target rotational speed calculation section 101 and the target torque TQt calculated by the target torque calculation section 102. In the target fuel pressure calculation section 103, a map indicating a relationship between a target fuel pressure Pt and each of a target rotational speed NEt and a target torque TQt is stored. This map is previously obtained by experiment and simulation. The target fuel pressure Pt is calculated so as to be higher when the target rotational speed NEt is high than when the target rotational speed NEt is low. Further, the target fuel pressure Pt is calculated so as to be higher when the target torque TQt is large than when the target torque TQt is small.

The fuel pressure difference calculation section 104 calculates a fuel pressure difference ΔP (ΔP=Pt−Pr), which is a value obtained by subtracting the fuel pressure Pr in the high-pressure fuel pipe 34 detected by the pressure sensor 92 from the target fuel pressure Pt calculated by the target fuel pressure calculation section 103.

The injection feedback amount calculation section 105 calculates an injection feedback amount FAF for feedback control of feeding the actual air-fuel ratio detected by the air-fuel ratio sensor 91 back to the target air-fuel ratio that is a target value of the air-fuel ratio. The target air-fuel ratio is calculated based on the operating state of the internal combustion engine 10 by the control device 100. The injection feedback amount calculation section 105 inputs a value obtained by subtracting the actual air-fuel ratio from the target air-fuel ratio to a proportional element, an integral element, and a differential element, and outputs as an injection feedback amount FAF the sum of an output value of the proportional element, an output value of the integral element, and an output value of the differential element.

The required injection amount calculation section 106 calculates a required fuel injection amount Qt that is a target value of the fuel amount injected from each fuel injection valve 15. The required injection amount calculation section 106 calculates a base injection amount Qb based on the target rotational speed NEt calculated by the target rotational speed calculation section 101 and the target torque TQt calculated by the target torque calculation section 102. The base injection amount Qb is calculated so as to be larger when the target rotational speed NEt is high than when the target rotational speed NEt is low. Further, the base injection amount Qb is calculated so as to be larger when the target torque TQt is large than when the target torque TQt is small. The base injection amount Qb is calculated as a fuel injection amount corresponding to the target air-fuel ratio. The required injection amount calculation section 106 calculates the required fuel injection amount Qt by multiplying the base injection amount Qb by the injection feedback amount FAF calculated by the injection feedback amount calculation section 105.

The injection time calculation section 107 calculates an injection time Fi that is a period of time of executing fuel injection for each fuel injection valve 15, based on the required fuel injection amount Qt calculated by the required injection amount calculation section 106 and the fuel pressure Pr detected by the pressure sensor 92.

The injection start timing calculation section 108 calculates an injection start time such that the fuel injection for the required fuel injection amount Qt calculated by the required injection amount calculation section 106 is completed before the ignition timing of the cylinder where the fuel injection valve 15 is disposed. In the present embodiment, a fixed point in time at which a predetermined crank angle before reaching the compression top dead center is calculated as an injection start timing Fs.

The injection valve driving section 109 drives each fuel injection valve 15 based on the crank angle CA detected by the crank angle sensor 95. At the injection start timing Fs of each fuel injection valve 15 calculated by the injection start timing calculation section 108, the injection valve driving section 109 controls the fuel injection valve 15 so that fuel injection from the fuel injection valve 15 is started. After the fuel injection is continued during the injection time Fi calculated by the injection time calculation section 107 from the start of the fuel injection, the injection valve driving section 109 ends the fuel injection from the fuel injection valve 15.

The target throttle opening degree calculation section 110 calculates a target throttle opening degree et that is a target value of the opening degree of the throttle valve 21 based on the target torque TQt calculated by the target torque calculation section 102.

The throttle driving section 111 controls the opening degree of the throttle valve 21 to realize the target throttle opening degree et calculated by the target throttle opening degree calculation section 110.

The injection interval calculation section 112 calculates an injection interval Int of fuel based on a fuel injection end timing Fe from the fuel injection valve 15, the injection start timing Fs calculated by the injection start timing calculation section 108, and the engine rotational speed NE detected by the crank angle sensor 95. The injection interval Int of fuel is calculated as a period of time from when the fuel injection is ended at the fuel injection valve 15 provided in any one of the cylinders to when the fuel injection is started at the fuel injection valve 15 provided in the cylinder to be ignited next. For example, in the present embodiment, the first cylinder #1, the third cylinder #3, the fourth cylinder #4, and the second cylinder #2 are ignited in this order. In this case, the injection interval calculation section 112 calculates as the injection interval Int of fuel each of a period of time from when the fuel injection in the first cylinder #1 is ended to when the fuel injection in the third cylinder #3 is started, and a period of time from when the fuel injection in the third cylinder #3 is ended to when the fuel injection in the fourth cylinder #4 is started. Further, the injection interval calculation section 112 calculates as the injection interval Int of fuel each of a period of time from when the fuel injection in the fourth cylinder #4 is ended to when the fuel injection in the second cylinder #2 is started, and a period of time from when the fuel injection in the second cylinder #2 is ended to when the fuel injection in the first cylinder #1 is started. The injection interval calculation section 112 calculates the fuel injection end timing Fe based on the injection time Fi calculated by the injection time calculation section 107 and the injection start timing Fs calculated by the injection start timing calculation section 108. In the present embodiment, since the injection start timing Fs is set to a fixed point in time at a crank angle, the injection interval Int of fuel becomes shorter as the end timing Fe of fuel injection is later and as the engine rotational speed NE is higher.

The discharge start timing calculation section 113 calculates a discharge start timing Ts that is a point in time at which fuel discharge from the high-pressure fuel pump 40 to the high-pressure fuel pipe 34 is started. The discharge start timing Ts is calculated based on the timing of fuel injection of the fuel injection valve 15. In the present embodiment, the discharge start timing Ts is set to the point in time at which a predetermined preparation time has elapsed from the end timing Fe of fuel injection of the fuel injection valve 15. The fuel injection end timing Fe can be calculated based on the injection time Fi calculated by the injection time calculation section 107 and the injection start timing Fs calculated by the injection start timing calculation section 108. The preparation time is set to be longer than the time required for the fuel pressure Pr in the high-pressure fuel pipe 34 to become stable after the fuel injection from the fuel injection valve 15 is ended. The preparation time is previously obtained by experiment and simulation and stored in the control device 100.

The target discharge amount calculation section 114 calculates a target discharge amount TPt that is a target value of the fuel discharge amount from the high-pressure fuel pump 40 to the high-pressure fuel pipe 34. In the present embodiment, the target discharge amount calculation section 114 calculates the target discharge amount TPt at a point in time when a predetermined convergence time has elapsed from the end timing Fe of fuel injection of the fuel injection valve 15. The convergence time is a time equal to the time required for the fuel pressure Pr in the high-pressure fuel pipe 34 to become stable after the fuel injection from the fuel injection valve 15 is ended, and is set to be shorter than the preparation time. The convergence time is previously obtained by experiment and simulation and stored in the control device 100. The target discharge amount calculation section 114 calculates a base discharge amount TPb based on the required fuel injection amount Qt calculated by the required injection amount calculation section 106. The base discharge amount TPb is calculated as an amount equal to the required fuel injection amount Qt. That is, the base discharge amount TPb increases as the required fuel injection amount Qt increases. Further, the target discharge amount calculation section 114 calculates a discharge feedback amount TK based on the fuel pressure difference ΔP calculated by the fuel pressure difference calculation section 104. In the present embodiment, a value obtained by subtracting from the target fuel pressure Pt the actual fuel pressure Pr after fuel is discharged from the high-pressure fuel pump 40 so as to reach the target fuel pressure Pt is input to a proportional element, an integral element, and an differential element, and the sum of an output value of the proportional element, an output value of the integral element, and an output value of the differential element is calculated as the discharge feedback amount TK. The target discharge amount calculation section 114 calculates the target discharge amount TPt by multiplying the base discharge amount TPb by the discharge feedback amount TK.

The pump characteristics learning section 115 learns a relationship between an energization time to the high-pressure fuel pump 40 and the amount of fuel discharged from the high-pressure fuel pump 40 to the high-pressure fuel pipe 34 as operation characteristics of the high-pressure fuel pump 40. The fuel discharge amount from the high-pressure fuel pump 40 is affected by the fuel temperature in the high-pressure fuel pipe 34 detected by the fuel temperature sensor 93, the temperature of the coil 85 detected by the coil temperature sensor 94, the battery voltage, etc.

Figure 6:
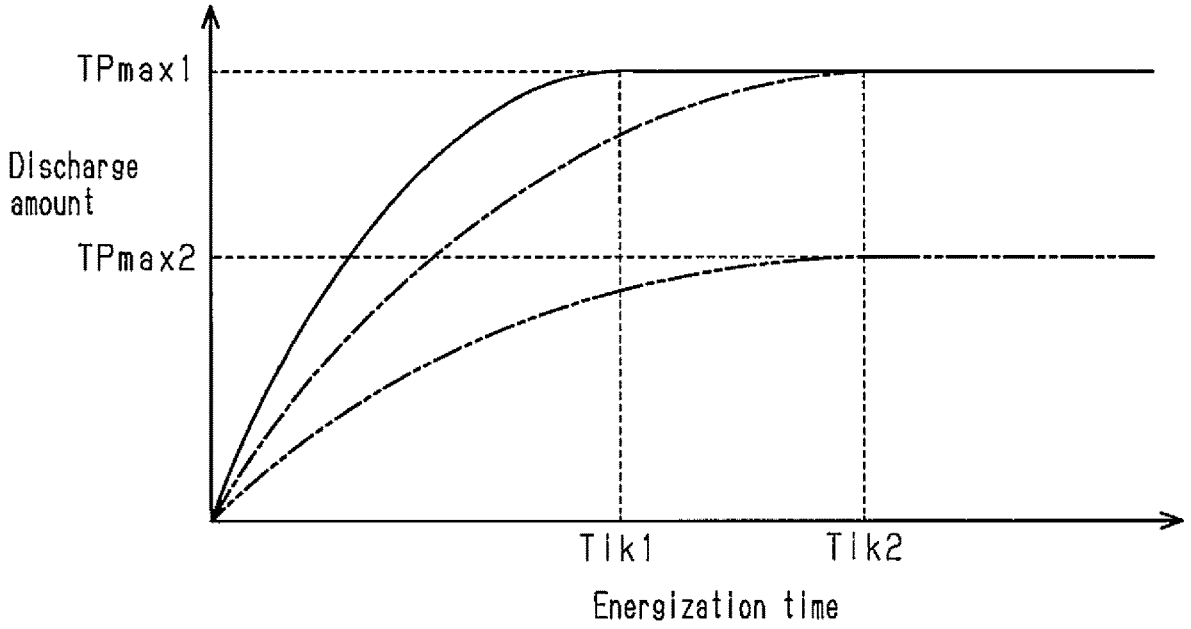
FIG. 6 is a graph showing a relationship between energization time and discharge amount in the high-pressure fuel pump in FIG. 2.

As shown in FIG. 6, the operation characteristics of the high-pressure fuel pump 40 has a tendency that the fuel discharge amount increases as the energization time is longer. In the high-pressure fuel pump 40, when energization of the high-pressure fuel pump 40 is started, the plunger 75 moves away from the protruded portion 83 from a state in which the plunger 75 is in contact with the protruded portion 83. Therefore, as indicated by the solid line in FIG. 6, as the elapsed time from the start of energization increases, the moving amount of the plunger 75 increases, the volume of the pressurizing chamber 78 decreases, and thus the amount of fuel discharged from the high-pressure fuel pump 40 increases. Then, when the elapsed time from the start of energization reaches the time (energization time Tik1) required for the plunger 75 to enter the state where the protrusion 75B of the plunger 75 is in contact with the insertion portion 56 from the state where the plunger 75 is in contact with the protruded portion 83, the fuel discharge amount from the high-pressure fuel pump 40 becomes a maximum discharge amount TPmax that is the maximum value of fuel discharge amount in one fuel discharge. After that time, the discharge amount does not change even if the energization time becomes longer. A maximum discharge amount TPmax1 shown in FIG. 6 is equal to a design maximum discharge amount that is the maximum value of discharge amount that can be realized by design in one fuel discharge from the high-pressure fuel pump 40.

The viscosity of the fuel is higher when the fuel temperature is low than when the fuel temperature is high. Therefore, the resistance in fuel discharge is larger when the fuel temperature is low than when the fuel temperature is high, and the moving speed of the plunger 75 is lowered. Accordingly, as indicated by the long dashed short dashed line in FIG. 6, the time (energization time Tik2) required for the discharge amount to reach the maximum discharge amount TPmax1 tends to become longer when the fuel temperature in the high-pressure fuel pipe 34 is low than when the fuel temperature in the high-pressure fuel pipe 34 is high as indicated by the solid line in FIG. 6 (Tik1<Tik2).

Further, the force to move the plunger 75 toward the pressurizing chamber 78 is weaker when the temperature of the coil 85 is high than when the temperature of the coil 85 is low. In addition, the force to move the plunger 75 toward the pressurizing chamber 78 is weaker when the battery voltage is low than when the battery voltage is high. Accordingly, as indicated by the long dashed double-short dashed line in FIG. 6, the maximum discharge amount TPmax that can be discharged per one time in the high-pressure fuel pump 40 may be lower when the temperature of the coil 85 is high or the battery voltage is low than when the temperature of the coil 85 is low and the battery voltage is high as indicated by the solid line in FIG. 6. Therefore, a maximum discharge amount TPmax2 in this case is smaller than the design maximum discharge amount (TPmax1).

As described above, in the high-pressure fuel pump 40, the energization time required for discharging a predetermined amount of fuel in one fuel discharge and the maximum value of fuel discharge amount that is possible to be discharged in one fuel discharge change depending on the current state of the high-pressure fuel pump 40. The pump characteristics learning section 115 calculates a unit discharge amount (as described later) that is a fuel amount in one fuel discharge from the high-pressure fuel pump 40 when the high-pressure fuel pump 40 is driven for the energization time set based on the target discharge amount TPt, on the basis of the fuel pressure difference ΔP calculated by the fuel pressure difference calculation section 104, and stores the unit discharge amount together with information of the fuel temperature, the temperature of the coil 85, and the battery voltage. The battery voltage can be obtained from a charge/discharge state of the battery 120.

The discharge count calculation section 116 calculates a necessary discharge count Tnf that is the number of times the high-pressure fuel pump 40 should discharge fuel to the high-pressure fuel pipe 34, based on the target discharge amount TPt calculated by the target discharge amount calculation section 114. The target discharge amount TPt is calculated based on the required fuel injection amount Qt and is a parameter correlated with the operating state of the internal combustion engine. That is, the discharge count calculation section 116 calculates the necessary discharge count Tnf based on the operating state of the internal combustion engine 10. The discharge count calculation section 116 calculates the smallest of the discharge counts necessary for discharging an amount of fuel corresponding to the target discharge amount TPt as the necessary discharge count Tnf. For example, when the target discharge amount TPt is less than the maximum discharge amount TPmax of the high-pressure fuel pump 40 that is the specified amount and the target discharge amount TPt is small, the necessary discharge count Tnf is calculated as one. Further, when the target discharge amount TPt is equal to or larger than the maximum discharge amount TPmax and less than twice the maximum discharge amount TPmax, the necessary discharge count Tnf is calculated as two times. That is, when the target discharge amount TPt is equal to or larger than the maximum discharge amount TPmax that is the specified amount and the target discharge amount TPt is large, the necessary discharge count Tnf is calculated as a plurality of times. The maximum discharge amount TPmax can be calculated based on the operation characteristics of the high-pressure fuel pump 40 learned by the pump characteristics learning section 115.

The unit discharge amount calculation section 117 sets a target unit discharge amount TPnf that is a target value of the unit discharge amount TPn that is a fuel amount to be discharged from the high-pressure fuel pump 40 per one time, based on the necessary discharge count Tnf set by the discharge count calculation section 116 and the target discharge amount TPt calculated by the target discharge amount calculation section 114. When the necessary discharge count Tnf is set to one, the unit discharge amount calculation section 117 sets the target discharge amount TPt to the target unit discharge amount TPnf. Further, when the discharge count is set to two times or more, the unit discharge amount calculation section 117 sets the target discharge amount TPnf by an amount obtained by dividing the target discharge amount TPt by the necessary discharge count Tnf (TPt/Tnf).

The driving amount setting section 118 sets a discharge count Tn of fuel discharged from the high-pressure fuel pump 40 to the high-pressure fuel pipe 34 between the fuel injection from the fuel injection valve 15 and the next fuel injection, and the unit discharge amount TPn in each discharge. The driving amount setting section 118 first calculates a necessary time Tnes required for discharging the target unit discharge amount TPnf set by the unit discharge amount calculation section 117 as many times as the necessary discharge count Tnf, based on the operation characteristics of the high-pressure fuel pump 40 learned by the pump characteristics learning section 115. For example, when the necessary discharge count Tnf is one, the necessary time Tnes is equal to a lift time Ti. Further, when the necessary discharge count Tnf is a plurality of times n ($2 \leq n$), the necessary time Tnes is equal to the sum of n times the lift time Ti and n−1 times a standby time. The lift time Ti is a time required from when the plunger 75 in contact with the protruded portion 83 starts to move to when the high-pressure fuel pump 40 discharges the fuel of the target unit discharge amount TPnf. Specifically, when the target unit discharge amount TPnf is equal to the maximum discharge amount TPmax, the moving time of the plunger 75 required from when the plunger 75 in contact with the protruded portion 83 starts to move to when the protrusion 75B of the plunger 75 comes into contact with the insertion portion 56 is the lift time Ti (for example, the energization time Tik1 in FIG. 6). Further, the standby time is a time taken for the plunger 75 to move from a first moving end away from the protruded portion 83 to a second moving end in contact with the protruded portion 83. Specifically, when the high-pressure fuel pump 40 discharges fuel corresponding to the maximum discharge amount TPmax, the standby time is a time for the plunger 75 to enter the state where the plunger 75 is in contact with the protruded portion 83 from the state where the protrusion 75B of the plunger 75 is in contact with the insertion portion 56. The lift time Ti and the standby time are calculated based on the operation characteristics of the high-pressure fuel pump 40. After the necessary time Tnes is calculated in this way, a time obtained by adding the preparation time to the necessary time Tnes is calculated as an execution time Tad. That is, the execution time Tad is a time required from when the fuel injection is ended to when the fuel discharge is completed, for fuel discharge executed between fuel injection and the next fuel injection. When the execution time Tad is equal to or less than the injection interval Int calculated by the injection interval calculation section 112, the driving amount setting section 118 sets the discharge count Tn to the same number as the necessary discharge count Tnf. Further, the driving amount setting section 118 sets the unit discharge amount TPn for each discharge to the same amount as the target unit discharge amount TPnf. As a result, when the discharge count Tn of fuel discharged from the high-pressure fuel pump 40 to the high-pressure fuel pipe 34 at the injection interval Int of the fuel injection valve 15 is a plurality of times, each unit discharge amount TPn in the plurality of times of fuel discharge is set to an amount smaller than the maximum discharge amount TPmax and the unit discharge amounts TPn in the plurality of times of fuel discharge are set to be equal to each other. In this case, the execution time Tad is set based on the discharge count Tn, the unit discharge amount TPn, and the operation characteristics of the high-pressure fuel pump 40.

On the other hand, when the calculated execution time Tad exceeds the injection interval Int calculated by the injection interval calculation section 112, the driving amount setting section 118 sets the discharge count Tn and the unit discharge amount TPn based on the injection interval Int such that the execution time Tad that is the time required for the high-pressure fuel pump 40 to complete the fuel discharge does not exceed the injection interval Int. In this case, in the present embodiment, the driving amount setting section 118 sets the discharge count Tn and the unit discharge amount TPn such that the discharge amount from the high-pressure fuel pump 40 at the injection interval Int becomes the maximum discharge amount. The relationship between the discharge count Tn and the unit discharge amount TPn with respect to the injection interval Int is previously obtained by experiment and simulation and stored in the control device 100. In this way, when the execution time Tad exceeds the injection interval Int, the driving amount setting section 118 calculates and sets the discharge count Tn and the unit discharge amount TPn, so that the upper limit of the execution time Tad is set depending on the injection interval Int.

The pump driving section 119 drives the high-pressure fuel pump 40 based on the discharge start timing Ts calculated by the discharge start timing calculation section 113, and the discharge count Tn and the unit discharge amount TPn that are set by the driving amount setting section 118. That is, the pump driving section 119 starts energization control for the coil 85 of the high-pressure fuel pump 40 at the discharge start timing Ts. The pump driving section 119 causes the plunger 75 to reciprocate through the energization control, thereby causing the high-pressure fuel pump 40 to execute fuel suction and fuel discharge. One reciprocation of the plunger 75 makes the high-pressure fuel pump 40 execute fuel discharge once. When the lift time Ti set based on the operation characteristics of the high-pressure fuel pump 40 learned by the pump characteristics learning section 115 has elapsed from the start of energization control for the high-pressure fuel pump 40, the pump driving section 119 ends the energization. Thus, the fuel discharge amount of the high-pressure fuel pump 40 per one time is controlled to be equal to the unit discharge amount TPn. When the discharge count Tn set by the driving amount setting section 118 is two times or more, the pump driving section 119 ends the energization control at the timing when the lift time Ti elapses from the start of the energization control, and executes the energization control again at the timing when a predetermined standby time elapses from the timing of the end. Then, the pump driving section 119 ends the energization control again at the timing when the lift time Ti has elapsed from the start of energization control again. By the repeated energization control, the high-pressure fuel pump 40 executes fuel discharge a plurality of times.

Figure 7:
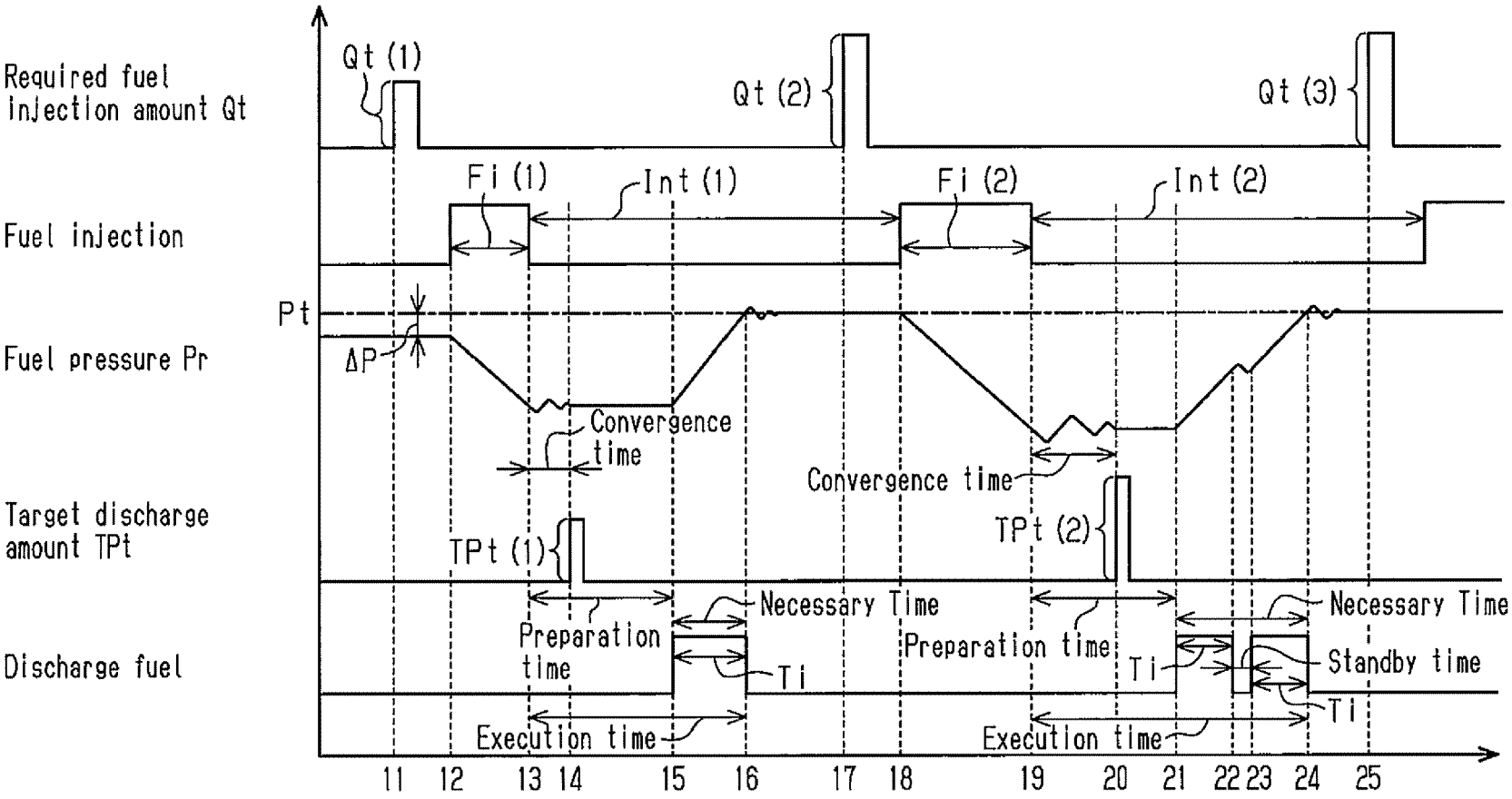
FIG. 7 is a timing diagram showing an example of a manner of fuel injection from a fuel injection valve and a manner of fuel discharge from the high-pressure fuel pump.
Figure 8:
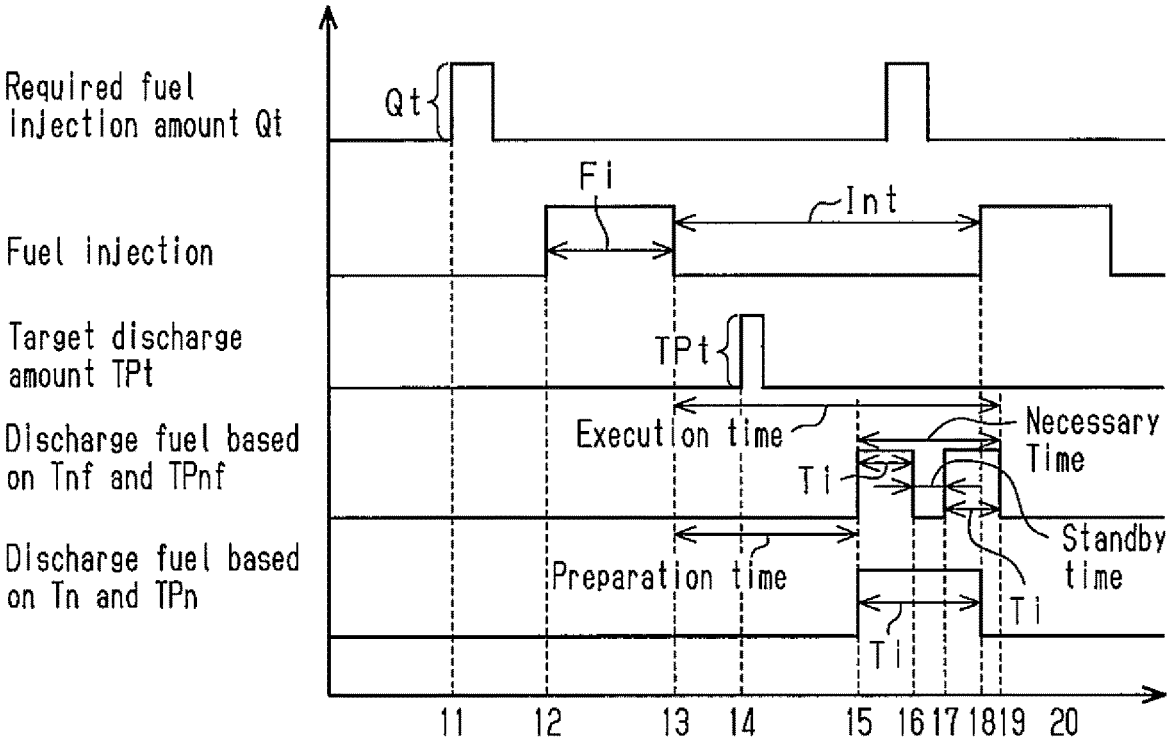
FIG. 8 is a timing diagram showing an example of a manner of fuel injection from the fuel injection valve and a manner of fuel discharge from the high-pressure fuel pump.

An operation and advantages of the present embodiment will now be described with reference to FIGS. 7 and 8. In the following description, the point in time of each operation in FIGS. 7 and 8 is indicated by t followed by three-digit numbers. However, in FIG. 7, the symbol t and the first digit 7 of the three digits are omitted. Further, in FIG. 8, the symbol t and the first digit 8 of the three digits are omitted.

First, an example of a manner of fuel discharge when the engine rotational speed NE of the internal combustion engine is low will be described with reference to FIG. 7.

The required injection amount calculation section 106 calculates a required fuel injection amount Qt(1) at a point in time t711. When the required fuel injection amount Qt(1) is calculated, the injection time calculation section 107 calculates an injection time Fi(1) that is the injection execution time of fuel injection based on the required fuel injection amount Qt(1) and the current fuel pressure Pr detected by the pressure sensor 92. Then, at a point in time t712, which is an injection start timing Fs calculated by the injection start timing calculation section 108 based on the crank angle CA detected by the crank angle sensor 95, the injection valve driving section 109 starts fuel injection from the fuel injection valve 15. The injection valve driving section 109 continues the fuel injection during the injection time Fi(1) calculated by the injection time calculation section 107, and ends the fuel injection at a point in time t713 when the injection time Fi(1) has elapsed from the point in time t712.

By executing this fuel injection, the fuel pressure Pr in the high-pressure fuel pipe 34 decreases. At the point in time t713 when the fuel injection is ended, the fuel injection is ended, but the fuel pressure Pr fluctuates for a while. A period of time from when the point in time t713, at which the fuel injection is ended, to when the fuel pressure Pr converges to a constant value is the convergence time described above.

The target discharge amount calculation section 114 calculates a target discharge amount TPt(1) at a point in time t714 when the convergence time has elapsed from the end timing Fe of the fuel injection (point in time t713). The target discharge amount TPt(1) is calculated based on the required fuel injection amount Qt(1) and a discharge feedback amount TK calculated based on a fuel pressure difference ΔP. Before the fuel injection is executed at the point in time t712, the difference ΔP (ΔP>0) occurs between the target fuel pressure Pt and the actual fuel pressure Pr. The discharge feedback amount TK is calculated as a value for feedback control to reduce the difference.

When the target discharge amount TPt(1) is calculated in this way, the discharge count calculation section 116 calculates a necessary discharge count Tnf for the high-pressure fuel pump 40 to discharge fuel to the high-pressure fuel pipe 34. In this example, since the target discharge amount TPt(1) is less than the maximum discharge amount TPmax based on the operation characteristics of the high-pressure fuel pump 40, the necessary discharge count Tnf is calculated as one. Then, the unit discharge amount calculation section 117 calculates the target discharge amount TPt(1) as a target unit discharge amount TPnf (TPnf=TPt(1)). When the necessary discharge count Tnf and the target unit discharge amount TPnf are calculated in this way, the driving amount setting section 118 sets a discharge count Tn of fuel for the period between the fuel injection from the fuel injection valve 15 and the next fuel injection, and a unit discharge amount TPn in each discharge.

The driving amount setting section 118 first calculates a necessary time Tnes (lift time Ti) required for performing fuel discharge by the discharge amount TPnf set by the unit discharge amount calculation section 117 as many times as the necessary discharge count Tnf, based on the operation characteristics of the high-pressure fuel pump 40 learned by the pump characteristics learning section 115. Then, the driving amount setting section 118 calculates a time obtained by adding the necessary time Tnes and the preparation time described above as an execution time Tad. Since the execution time Tad is equal to or less than an injection interval Int(1) calculated by the injection interval calculation section 112, the driving amount setting section 118 sets the discharge count Tn to the same number as the necessary discharge count Tnf, and sets the unit discharge amount TPn to be equal to the target unit discharge amount TPnf.

After that, the pump driving section 119 drives the high-pressure fuel pump 40 so that fuel discharge is executed at a discharge start timing Ts calculated by the discharge start timing calculation section 113. In this case, the pump driving section 119 performs fuel discharge once from the high-pressure fuel pump 40 to the high-pressure fuel pipe 34 at a point in time t715 when the preparation time described above has elapsed from the point in time t713, at which the fuel injection is ended. The fuel discharge is executed during the period between the point in time t715 and a point in time t716 when the lift time Ti corresponding to the target unit discharge amount TPnf has elapsed.

By executing this fuel discharge, the fuel pressure Pr in the high-pressure fuel pipe 34 increases. At the point in time t716, the fuel discharge is ended, however, pressure fluctuations occur in the fuel in the high-pressure fuel pipe 34 for a while. As the unit discharge amount TPn from the high-pressure fuel pump 40 increases, the pressure fluctuations of the fuel tend to increase. The fuel pressure Pr converges to a target fuel pressure Pt when a predetermined time has elapsed from the point in time t716, at which the fuel discharge is ended.

After that, at a point in time t717 after the fuel pressure Pr converges to a constant value, the required injection amount calculation section 106 calculates a required fuel injection amount Qt(2) for the next fuel injection. The required fuel injection amount Qt(2) is larger than the required fuel injection amount Qt(1) (Qt(2)>Qt(1)). When the required fuel injection amount Qt(2) is calculated, the injection time calculation section 107 calculates an injection time Fi(2) that is the injection execution time of fuel injection based on the required fuel injection amount Qt(2) and the current fuel pressure Pr detected by the pressure sensor 92. At the point in time t717, the fuel pressure Pr is equal to the target fuel pressure Pt. The injection valve driving section 109 starts fuel injection from the fuel injection valve 15 at a point in time t718, which is the injection start timing Fs. The injection valve driving section 109 continues the fuel injection during the injection time Fi calculated by the injection time calculation section 107, and ends the fuel injection at a point in time t719 when the injection time Fi(2) has elapsed from the point in time t718.

By executing this fuel injection, the fuel pressure Pr in the high-pressure fuel pipe 34 decreases. More fuel is injected in the fuel injection during the period between the point in time t718 and the point in time t719 than in the previous fuel injection during the period between the point in time t712 and the point in time t713. Therefore, at the point in time t719, at which the fuel injection is ended, the fuel pressure is lower than in the previous fuel injection. Further, since the injected fuel amount is large, the pressure fluctuations of the fuel occurring after the fuel injection are also larger than in the previous fuel injection. Therefore, the convergence time in the subsequent fuel injection is longer than the convergence time in the previous fuel injection.

The target discharge amount calculation section 114 calculates a target discharge amount TPt(2) at a point in time t720 when the convergence time has elapsed from the end timing Fe (point in time t719) of the fuel injection. The target discharge amount TPt(2) is calculated based on the required fuel injection amount Qt(2) and a discharge feedback amount TK calculated based on a fuel pressure difference ΔP. Immediately before the fuel injection is executed at the point in time t718, the actual fuel pressure Pr is equal to the target fuel pressure Pt and thus there is no difference. On the other hand, the required fuel injection amount Qt(2) is larger than the required fuel injection amount Qt(1). In the example shown in FIG. 7, the target discharge amount TPt(2) is calculated as a value larger than the target discharge amount TPt(1).

When the target discharge amount TPt(2) is calculated, the discharge count calculation section 116 calculates a necessary discharge count Tnf. In this example, since the target discharge amount TPt(2) is equal to or larger than the maximum discharge amount TPmax based on the operation characteristics of the high-pressure fuel pump 40 and less than twice the maximum discharge amount TPmax, the necessary discharge count Tnf is calculated as two times. Then, the unit discharge amount calculation section 117 calculates a value obtained by dividing the target discharge amount TPt(2) by 2 as the target unit discharge amount TPnf (TPnf=TPt(2)/2). When the necessary discharge count Tnf and the target unit discharge amount TPnf are calculated in this way, the driving amount setting section 118 sets a discharge count Tn of fuel for the period between the fuel injection from the fuel injection valve 15 and the next fuel injection, and a unit discharge amount TPn in each discharge.

The driving amount setting section 118 first calculates a necessary time Tnes (Tnes=2×lift time Ti+1×standby time) required for performing fuel discharge by the discharge amount TPnf set by the unit discharge amount calculation section 117 as many times as the necessary discharge count Tnf, based on the operation characteristics of the high-pressure fuel pump 40 learned by the pump characteristics learning section 115. Then, the driving amount setting section 118 calculates a time obtained by adding the necessary time Tnes and the preparation time described above as an execution time Tad. Since the execution time Tad is equal to or less than an injection interval Int(2) calculated by the injection interval calculation section 112, the driving amount setting section 118 sets the discharge count Tn to the same number as the necessary discharge count Tnf, and sets the unit discharge amount TPn to be equal to the target unit discharge amount TPnf.

After that, the pump driving section 119 drives the high-pressure fuel pump 40 so that fuel discharge is started at a discharge start timing Ts calculated by the discharge start timing calculation section 113. In this case, the pump driving section 119 performs fuel discharge two times from the high-pressure fuel pump 40 to the high-pressure fuel pipe 34 at a point in time t721 when the preparation time described above has elapsed from the point in time t719, at which the fuel injection is ended. The first fuel discharge is executed during the period between the point in time t721 and a point in time t722 when the lift time Ti corresponding to the target unit discharge amount TPnf has elapsed. The pump driving section 119 starts the second fuel discharge at a point in time t723 when the standby time has elapsed from the point in time t722, at which the first fuel discharge is ended. The second fuel discharge is executed during the period between the point in time t723 and a point in time t724 when the lift time Ti has elapsed. The first lift time Ti is equal to the second lift time Ti.

After that, at the point in time t725 after the fuel discharge, the required injection amount calculation section 106 calculates a required fuel injection amount Qt(3) for the next fuel injection, and then the fuel injection is performed.

In this way, in the present embodiment, the discharge count Tn of fuel discharged from the high-pressure fuel pump 40 and the unit discharge amount TPn for the period between the fuel injection from the fuel injection valve 15 and the next fuel injection are controlled based on the required fuel injection amount Qt that is correlated with the operating state of the internal combustion engine 10. Depending on the amount of fuel discharged from the high-pressure fuel pump 40 to the high-pressure fuel pipe 34, the magnitude of pressure fluctuations of the fuel in the high-pressure fuel pipe 34 changes. The discharge count Tn of the high-pressure fuel pump 40 and the unit discharge amount TPn for the period between the fuel injection and the next fuel injection are controlled based on the operating state of the internal combustion engine 10. This makes it possible to realize a supply of fuel that makes it difficult for an excess or a shortage of fuel in the high-pressure fuel pipe 34 to occur, while taking into consideration the influence of the pressure fluctuations of the fuel in the high-pressure fuel pipe 34 due to the fuel discharge from the high-pressure fuel pump 40. In addition, since fuel discharge can be performed a plurality of times during the period between the fuel injection and the next fuel injection depending on the operating state of the internal combustion engine 10, it is possible to supply an amount of fuel corresponding to the target discharge amount TPt to the high-pressure fuel pipe 34 regardless of the design maximum discharge amount that is the maximum value of discharge amount that can be realized by design in one fuel discharge from the high-pressure fuel pump 40. Therefore, the controllability of the fuel pressure Pr in the high-pressure fuel pipe 34 can be improved.

Further, as shown in FIG. 7, in this embodiment, fuel is discharged two times at the point in time t721. Since the unit discharge amount TPn in each fuel discharge is smaller than the maximum discharge amount TPmax, it is possible to reduce the pressure fluctuations of the fuel occurring in the high-pressure fuel pipe 34 after the fuel discharge at the point in time t724. Further, when fuel is discharged from the high-pressure fuel pump 40 to the high-pressure fuel pipe 34, the protrusion 75B of the plunger 75 is prevented from coming into contact with the insertion portion 56, so that it also contributes to the suppression of sound generated at the high-pressure fuel pump 40.

When fuel discharge is performed a plurality of times, the target unit discharge amount TPnf (TPnf=TPt/Tnf) is set to the amount obtained by dividing the target discharge amount TPt by the necessary discharge count Tnf and the unit discharge amounts TPn of the respective fuel discharges are set to be equal to each other. Accordingly, the amount of fuel supplied in one fuel discharge from the high-pressure fuel pump 40 to the high-pressure fuel pipe 34 is constant, and this allows similar pressure fluctuations of the fuel in the high-pressure fuel pipe 34 caused by the fuel discharge to occur in the respective discharges.

Next, an example of a manner of fuel discharge when the engine rotational speed NE of the internal combustion engine is high will be described with reference to FIG. 8.

The required injection amount calculation section 106 calculates a required fuel injection amount Qt at a point in time t811. When the required fuel injection amount Qt is calculated, the injection time calculation section 107 calculates an injection time Fi that is the injection execution time of fuel injection based on the required fuel injection amount Qt and the current fuel pressure Pr detected by the pressure sensor 92. Then, at a point in time t812, which is an injection start timing Fs calculated by the injection start timing calculation section 108 based on the crank angle CA detected by the crank angle sensor 95, the injection valve driving section 109 starts fuel injection from the fuel injection valve 15. The injection valve driving section 109 continues the fuel injection during the injection time Fi calculated by the injection time calculation section 107, and ends the fuel injection at a point in time t813 when the injection time Fi has elapsed from the point in time t812.

The target discharge amount calculation section 114 calculates a target discharge amount TPt at a point in time t814 when the convergence time has elapsed from the end timing Fe (point in time t813) of the fuel injection from the fuel injection valve 15. When the target discharge amount TPt is calculated in this way, the discharge count calculation section 116 calculates a necessary discharge count Tnf for the high-pressure fuel pump 40 to discharge fuel to the high-pressure fuel pipe 34. In this example, the target discharge amount TPt is 1.2 times the maximum discharge amount TPmax (TPt=1.2×TPmax). Accordingly, the necessary discharge count Tnf is set to two times to calculate the target discharge amount TPt, and the unit discharge amount calculation section 117 calculates a value obtained by dividing the target discharge amount TPt by 2 as the target unit discharge amount TPnf (TPnf=0.6×TPmax). When the necessary discharge count Tnf and the target unit discharge amount TPnf are calculated in this way, the driving amount setting section 118 sets a discharge count Tn of fuel for the period between the fuel injection from the fuel injection valve 15 and the next fuel injection, and a unit discharge amount TPn in each discharge.

In order to clarify the advantages of the present embodiment, as a comparative example to the present embodiment, a case where the driving amount setting section 118 first sets the discharge count Tn to the same number of times as the necessary discharge count Tnf, and sets the unit discharge amount TPn to the same amount as the target unit discharge amount TPnf will be described.

When the discharge count Tn and the unit discharge amount TPn are set, the pump driving section 119 drives the high-pressure fuel pump 40 so that fuel discharge is started at a discharge start timing Ts calculated by the discharge start timing calculation section 113. In this case, the pump driving section 119 performs fuel discharge two times from the high-pressure fuel pump 40 to the high-pressure fuel pipe 34 at a point in time t815 when the preparation time described above has elapsed from the point in time t813, at which the fuel injection is ended. The first fuel discharge is executed during the period between the point in time t815 and a point in time t816 when the lift time Ti corresponding to the target unit discharge amount TPnf has elapsed. The pump driving section 119 starts the second fuel discharge at a point in time t817 when the standby time has elapsed from the point in time t816, at which the first fuel discharge is ended. The second fuel discharge is executed during the period between the point in time t817 and a point in time t819 when the lift time Ti has elapsed. In this comparative example, the execution time Tad, which is obtained by adding a necessary time Tnes (Tnes=2×lift time Ti+1×standby time) required for performing the fuel discharge of the target unit discharge amount TPnf from the high-pressure fuel pump 40 as many times as the necessary discharge count Tnf and the preparation time described above, exceeds the injection interval Int calculated by the injection interval calculation section 112.

In the present embodiment, when the execution time Tad exceeds the injection interval Int in this way, the discharge count Tn and the unit discharge amount TPn are set such that the execution time Tad does not exceed the injection interval Int.

Specifically, the driving amount setting section 118 first calculates a necessary time Tnes (Tnes=2×lift time Ti+1×standby time) required for performing fuel discharge by the discharge amount TPnf set by the unit discharge amount calculation section 117 as many times as the necessary discharge count Tnf, based on the operation characteristics of the high-pressure fuel pump 40 learned by the pump characteristics learning section 115. Then, the driving amount setting section 118 calculates a time obtained by adding the necessary time Tnes and the preparation time described above as an execution time Tad. In this case, since the execution time Tad exceeds the injection interval Int calculated by the injection interval calculation section 112, the driving amount setting section 118 sets the discharge count Tn and the unit discharge amount TPn such that the amount of fuel discharged from the high-pressure fuel pump 40 is the maximum discharge amount. In this example, the injection interval Int is equal to the sum of the necessary time required for discharging the fuel of the maximum discharge amount TPmax once and the preparation time. Accordingly, the driving amount setting section 118 sets the discharge count Tn to one, and sets the unit discharge amount TPn to the same amount as the maximum discharge amount TPmax. The relationship between the discharge count Tn and the unit discharge amount TPn with respect to the injection interval Int is previously obtained by experiment and simulation and stored in the control device 100.

In this way, when the discharge count Tn and the unit discharge amount TPn are set, the pump driving section 119 drives the high-pressure fuel pump 40 so that fuel discharge is started at a discharge start timing Ts (point in time t815) calculated by the discharge start timing calculation section 113. In this case, the pump driving section 119 performs fuel discharge once from the high-pressure fuel pump 40 to the high-pressure fuel pipe 34 at a point in time t815 when the preparation time described above has elapsed from the point in time t813, at which the fuel injection is ended. The fuel discharge is executed during the period between the point in time t815 and a point in time t818 when the lift time Ti corresponding to the unit discharge amount TPn (TPn=maximum discharge amount TPmax) has elapsed. The point in time t818 at which the fuel injection is ended is the same as the injection start timing Fs of the next fuel injection. Accordingly, the fuel discharge is ended when the next fuel injection is started.

When the execution time Tad exceeds the injection interval Int in this way, the discharge count Tn and the unit discharge amount TPn are set such that the execution time Tad does not exceed the injection interval Int. In order to discharge fuel from the high-pressure fuel pump 40 once, a time corresponding to the amount of fuel to be discharged is required. Further, the time taken to discharge the fuel from the high-pressure fuel pump 40 also varies depending on the operation characteristics of the high-pressure fuel pump 40 such as the viscosity of the fuel. In the present embodiment, the upper limit of the execution time Tad, which is set based on the discharge count Tn, the unit discharge amount TPn, and the operation characteristics of the high-pressure fuel pump 40, is shorter when the injection interval Int of fuel is short than when the injection interval Int of fuel is long. Thus, it is possible to prevent the execution time Tad from becoming longer than the injection interval Int of fuel. As a result, it is possible to complete the discharge of fuel within the injection interval Int of fuel, which is a limited period. Therefore, when fuel injection is being executed, fluctuations in the fuel pressure in the high-pressure fuel pipe 34 caused by fuel discharge from the high-pressure fuel pump 40 can be reduced.

In the present embodiment, when the target discharge amount TPt is small, the discharge count Tn is set to one; when the target discharge amount TPt is large, the discharge count Tn is set to two times or more. Accordingly, when it is necessary to supply a large amount of fuel to the high-pressure fuel pipe 34, fuel discharge is performed a plurality of times; when it is unnecessary to supply such a large amount of fuel to the high-pressure fuel pipe 34, fuel discharge is performed once. Therefore, it is possible to appropriately set the discharge count Tn.

Second Embodiment

Figure 9:
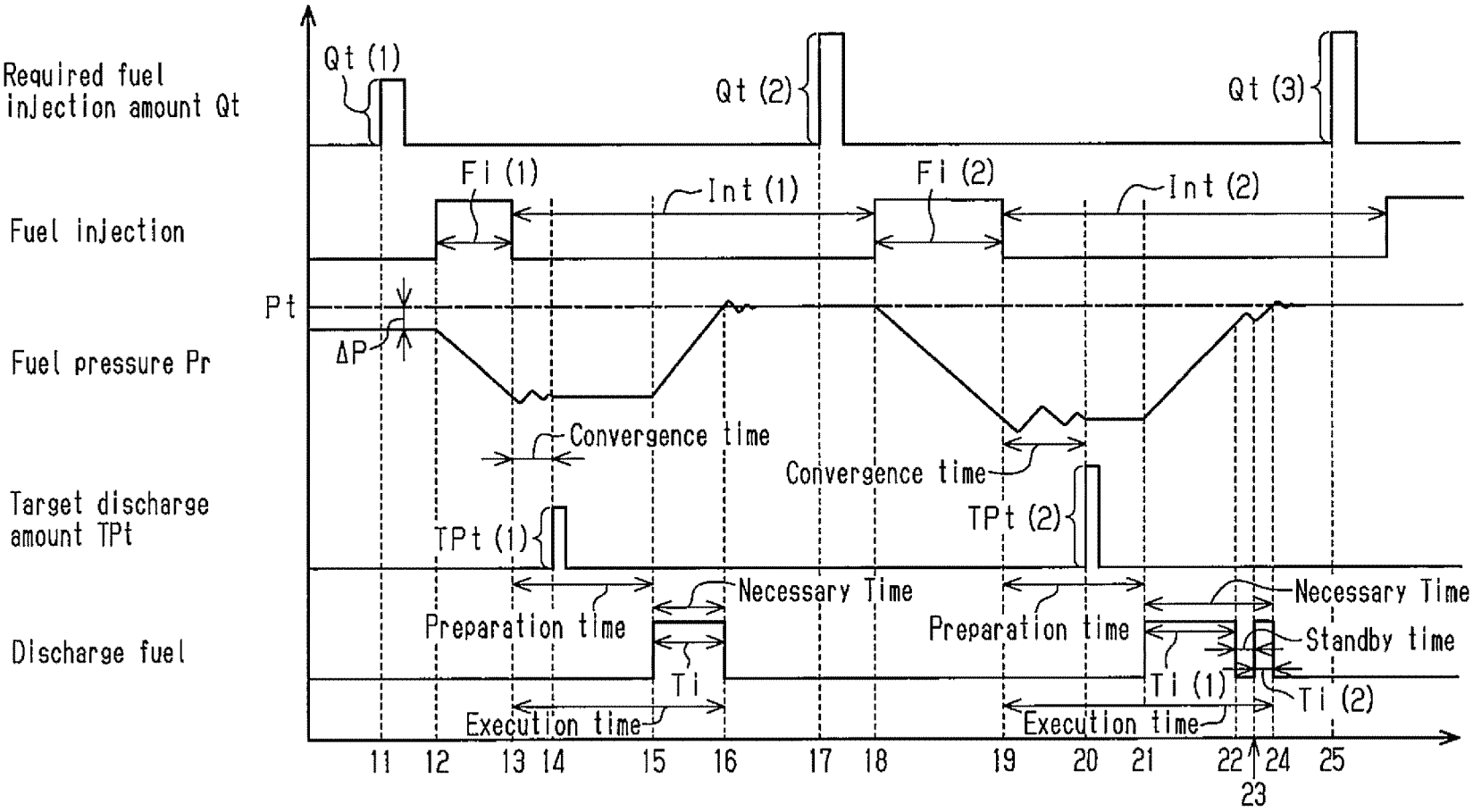
FIG. 9 is a timing diagram showing an example of a manner of fuel injection from the fuel injection valve and a manner of fuel discharge from the high-pressure fuel pump according to a second embodiment.

A control device for a fuel pump according to a second embodiment will be described with reference to FIG. 9. The second embodiment differs from the first embodiment in the manner in which the unit discharge amount TPn is set. The same constituent elements as those in the first embodiment are denoted by the same reference numerals, and description thereof is omitted. In FIG. 9, regarding a symbol t indicating the point in time of each operation and three-digit numbers following the symbol, the symbol t and the first digit 9 of the three digits are omitted.

As shown in FIG. 9, the required injection amount calculation section 106 calculates a required fuel injection amount Qt(1) at a point in time t911. When the required fuel injection amount Qt(1) is calculated, the injection time calculation section 107 calculates an injection time Fi(1) that is the injection execution time of fuel injection based on the required fuel injection amount Qt(1) and the current fuel pressure Pr detected by the pressure sensor 92. Then, at a point in time t912, which is an injection start timing Fs calculated by the injection start timing calculation section 108 based on the crank angle CA detected by the crank angle sensor 95, the injection valve driving section 109 starts fuel injection from the fuel injection valve 15. The injection valve driving section 109 continues the fuel injection during an injection time Fi calculated by the injection time calculation section 107, and ends the fuel injection at a point in time t913 when the injection time Fi(1) has elapsed from the point in time t912.

By executing this fuel injection, the fuel pressure Pr in the high-pressure fuel pipe 34 decreases. Then, fluctuations occur in the fuel pressure Pr for a while after the point in time t913, at which the fuel injection is ended. A period of time from when the point in time t913, at which the fuel injection is ended, to when the fuel pressure Pr converges to a constant value is the convergence time described above.

The target discharge amount calculation section 114 calculates a target discharge amount TPt(1) at a point in time t914 when the convergence time has elapsed from the end timing Fe (point in time t913) of the fuel injection. The target discharge amount TPt(1) is calculated based on the required fuel injection amount Qt(1) and a discharge feedback amount TK calculated based on a fuel pressure difference ΔP.

When the target discharge amount TPt(1) is calculated, the discharge count calculation section 116 calculates a necessary discharge count Tnf for the high-pressure fuel pump 40 to discharge fuel to the high-pressure fuel pipe 34. In this example, since the target discharge amount TPt(1) is less than the maximum discharge amount TPmax based on the operation characteristics of the high-pressure fuel pump 40, the necessary discharge count Tnf is calculated as one. Then, the unit discharge amount calculation section 117 calculates the target discharge amount TPt(1) as a target unit discharge amount TPnf (TPnf=TPt(1)). When the necessary discharge count Tnf and the target unit discharge amount TPnf are calculated in this way, the driving amount setting section 118 sets a discharge count Tn of fuel for the period between the fuel injection from the fuel injection valve 15 and the next fuel injection, and a unit discharge amount TPn in each discharge.

The driving amount setting section 118 first calculates a necessary time Tnes (lift time Ti) required for performing fuel discharge by the target unit discharge amount TPnf set by the unit discharge amount calculation section 117 as many times as the necessary discharge count Tnf, based on the operation characteristics of the high-pressure fuel pump 40 learned by the pump characteristics learning section 115. Then, the driving amount setting section 118 calculates a time obtained by adding the necessary time Tnes and the preparation time described above as an execution time Tad. Since the execution time Tad is equal to or less than an injection interval Int(1) calculated by the injection interval calculation section 112, the driving amount setting section 118 sets the discharge count Tn to the same number as the necessary discharge count Tnf, and sets the unit discharge amount TPn to be equal to the target unit discharge amount TPnf.

After that, the pump driving section 119 drives the high-pressure fuel pump 40 so that fuel discharge is executed at a discharge start timing Ts calculated by the discharge start timing calculation section 113. In this case, the pump driving section 119 performs fuel discharge once from the high-pressure fuel pump 40 to the high-pressure fuel pipe 34 at a point in time t915 when the preparation time described above has elapsed from the point in time t913, at which the fuel injection is ended. The fuel discharge is executed during the period between the point in time t915 and a point in time t916 when the lift time Ti corresponding to the target unit discharge amount TPnf has elapsed.

By executing this fuel discharge, the fuel pressure Pr in the high-pressure fuel pipe 34 increases. At the point in time t916, the fuel discharge is ended, but pressure fluctuations occur in the fuel in the high-pressure fuel pipe 34 for a while. As the unit discharge amount TPn from the high-pressure fuel pump 40 increases, the pressure fluctuations of the fuel tend to increase. The fuel pressure Pr converges to a target fuel pressure Pt when a predetermined time has elapsed from the point in time t916, at which the fuel discharge is ended.

After that, at a point in time t917 after the fuel pressure Pr converges to a constant value, the required injection amount calculation section 106 calculates a required fuel injection amount Qt(2) for the next fuel injection. The required fuel injection amount Qt(2) is larger than the required fuel injection amount Qt(1) (Qt(2)>Qt(1)). When the required fuel injection amount Qt(2) is calculated, the injection time calculation section 107 calculates an injection time Fi(2) that is the injection execution time of fuel injection based on the required fuel injection amount Qt(2) and the current fuel pressure Pr detected by the pressure sensor 92. At the point in time t917, the fuel pressure Pr is equal to the target fuel pressure Pt. The injection valve driving section 109 starts fuel injection from the fuel injection valve 15 at a point in time t918, which is the injection start timing Fs. The injection valve driving section 109 continues the fuel injection during an injection time Fi calculated by the injection time calculation section 107, and ends the fuel injection at a point in time t919 when the injection time Fi(2) has elapsed from the point in time t918.

By executing this fuel injection, the fuel pressure Pr in the high-pressure fuel pipe 34 decreases. More fuel is injected in the fuel injection during the period between the point in time t918 and the point in time t919 than in the previous fuel injection during the period between the point in time t912 and the point in time t913. Therefore, at the point in time t919, at which the fuel injection is ended, the fuel pressure is lower than in the previous fuel injection. Further, since the injected fuel amount is large, the pressure fluctuations of the fuel occurring after the fuel injection are also larger than in the previous fuel injection. Therefore, the convergence time in the subsequent fuel injection is longer than the convergence time in the previous fuel injection.

The target discharge amount calculation section 114 calculates a target discharge amount TPt(2) at a point in time t920 when the convergence time has elapsed from the end timing Fe (point in time t919) of the fuel injection. The target discharge amount TPt(2) is calculated based on the required fuel injection amount Qt(2) and a discharge feedback amount TK calculated based on a fuel pressure difference ΔP. Immediately before the fuel injection is executed at the point in time t918, the actual fuel pressure Pr is equal to the target fuel pressure Pt and thus there is no difference. On the other hand, the required fuel injection amount Qt(2) is larger than the required fuel injection amount Qt(1). In the example shown in FIG. 9, the target discharge amount TPt(2) is calculated as a value larger than the target discharge amount TPt(1).

When the target discharge amount TPt(2) is calculated, the discharge count calculation section 116 calculates a necessary discharge count Tnf. In this example, since the target discharge amount TPt(2) is equal to or larger than the maximum discharge amount TPmax based on the operation characteristics of the high-pressure fuel pump 40 and less than twice the maximum discharge amount TPmax, the necessary discharge count Tnf is calculated as two times.

The unit discharge amount calculation section 117 in the present embodiment calculates the target unit discharge amount TPnf as follows. That is, the unit discharge amount calculation section 117 calculates the first target unit discharge amount TPnf in a plurality of times of fuel discharge, that is, a first target unit discharge amount TPnf(1) as the same amount as the maximum discharge amount TPmax (TPnf(1)=TPmax). Then, the unit discharge amount calculation section 117 calculates the subsequent target unit discharge amount TPnf in the plurality of times of fuel discharge, that is, a second target unit discharge amount TPnf(2) as the same amount as the amount obtained by subtracting the maximum discharge amount TPmax from the target discharge amount TPt(2) (TPnf(2)=TPt−TPmax).

When the necessary discharge count Tnf and the target unit discharge amount TPnf are calculated in this way, the driving amount setting section 118 sets a discharge count Tn of fuel for the period between the fuel injection from the fuel injection valve 15 and the next fuel injection, and a unit discharge amount TPn in each discharge.

The driving amount setting section 118 first calculates a necessary time Tnes required for discharging the target unit discharge amount TPnf set by the unit discharge amount calculation section 117 as many times as the necessary discharge count Tnf, based on the operation characteristics of the high-pressure fuel pump 40 learned by the pump characteristics learning section 115. In this case, the necessary time Tnes is equal to the sum of a lift time Ti(1) taken to discharge the fuel of the target unit discharge amount TPnf(1), the standby time, and a lift time Ti(2) taken to discharge the fuel of the target unit discharge amount TPnf(2). Then, the driving amount setting section 118 calculates a time obtained by adding the necessary time Tnes and the preparation time described above as an execution time Tad. Since the execution time Tad is equal to or less than an injection interval Int(2) calculated by the injection interval calculation section 112, the driving amount setting section 118 sets the discharge count Tn to the same number as the necessary discharge count Tnf. In addition, the driving amount setting section 118 sets the unit discharge amount TPn(1) in the first fuel discharge to the same amount as the target unit discharge amount TPnf(1), and sets the unit discharge amount TPn(2) in the second fuel discharge to the same amount as the target unit discharge amount TPnf(2).

After that, the pump driving section 119 drives the high-pressure fuel pump 40 so that fuel discharge is started at a discharge start timing Ts calculated by the discharge start timing calculation section 113. In this case, the pump driving section 119 performs fuel discharge two times from the high-pressure fuel pump 40 to the high-pressure fuel pipe 34 at a point in time t921 when the preparation time described above has elapsed from the point in time t919 at which the fuel injection is ended. The first fuel discharge is executed during the period between the point in time t921 and a point in time t922 when the lift time Ti(1) corresponding to the target unit discharge amount TPnf(1) has elapsed. The pump driving section 119 starts the second fuel discharge at a point in time t923 when the standby time has elapsed from the point in time t922, at which the first fuel discharge is ended. The second fuel discharge is executed during the period between the point in time t923 and a point in time t924 when the lift time Ti(2) corresponding to the target unit discharge amount TPnf(2) has elapsed. The first lift time Ti(1) is longer than the second lift time Ti(2).

After that, at the point in time t925 after the fuel discharge, the required injection amount calculation section 106 calculates a required fuel injection amount Qt(3) for the next fuel injection, and then the fuel injection is performed.

In this way, in the present embodiment, the discharge count Tn of fuel discharged from the high-pressure fuel pump 40 and the unit discharge amount TPn for the period between the fuel injection from the fuel injection valve 15 and the next fuel injection are controlled based on the required fuel injection amount Qt that is correlated with the operating state of the internal combustion engine 10. Depending on the amount of fuel discharged from the high-pressure fuel pump 40 to the high-pressure fuel pipe 34, the magnitude of pressure fluctuations of the fuel in the high-pressure fuel pipe 34 changes. The control of the discharge count Tn and the unit discharge amount TPn of the fuel pump for the period between the fuel injection from the fuel injection valve 15 and the next fuel injection based on the operating state of the internal combustion engine 10 makes it possible to realize a supply of fuel that makes it difficult for an excess or a shortage of fuel in the high-pressure fuel pipe 34 to occur when the fuel of the target discharge amount TPt is discharged from the high-pressure fuel pump 40 to the high-pressure fuel pipe 34, while taking into consideration the influence of the pressure fluctuations of the fuel in the high-pressure fuel pipe 34 due to the fuel discharge from the high-pressure fuel pump 40. In addition, since fuel discharge can be performed a plurality of times during the period between the fuel injection and the next fuel injection depending on the operating state of the internal combustion engine 10, it is possible to supply an amount of fuel corresponding to the target discharge amount TPt to the high-pressure fuel pipe 34 regardless of the design maximum discharge amount that is the maximum value of discharge amount that can be realized by design in one fuel discharge from the high-pressure fuel pump 40. Therefore, the controllability of the fuel pressure Pr in the high-pressure fuel pipe 34 can be improved.

The first unit discharge amount TPn is set to the same amount as the maximum discharge amount TPmax when fuel discharge is performed a plurality of times, and the subsequent unit discharge amount is set to be smaller than the maximum discharge amount TPmax. In this case, as shown in FIG. 9, the fuel pressure Pr increases relatively greatly after the point in time t922, at which the first fuel discharge is ended, so that the fluctuations in the fuel pressure increase. On the other hand, in the second fuel discharge thereafter, the fuel pressure Pr does not increase so much after the point in time t924, at which the second fuel discharge is ended, so that the pressure fluctuations of the fuel are less than those in the first fuel discharge. In this way, in the case where fuel discharge is repeated, the reduced magnitude of the pressure fluctuations of the fuel in the last fuel discharge as compared to the magnitude of the pressure fluctuations of the fuel in the first fuel discharge makes it possible to shorten the fluctuation period of the pressure fluctuations in fuel.

Third Embodiment

A control device for a fuel pump according to a third embodiment will be described with reference to FIGS. 10 and 11. The third embodiment differs from the first embodiment in the manner in which the high-pressure fuel pump 40 is driven. The same constituent elements as those in the first embodiment are denoted by the same reference numerals, and description thereof is omitted.

Figure 10:
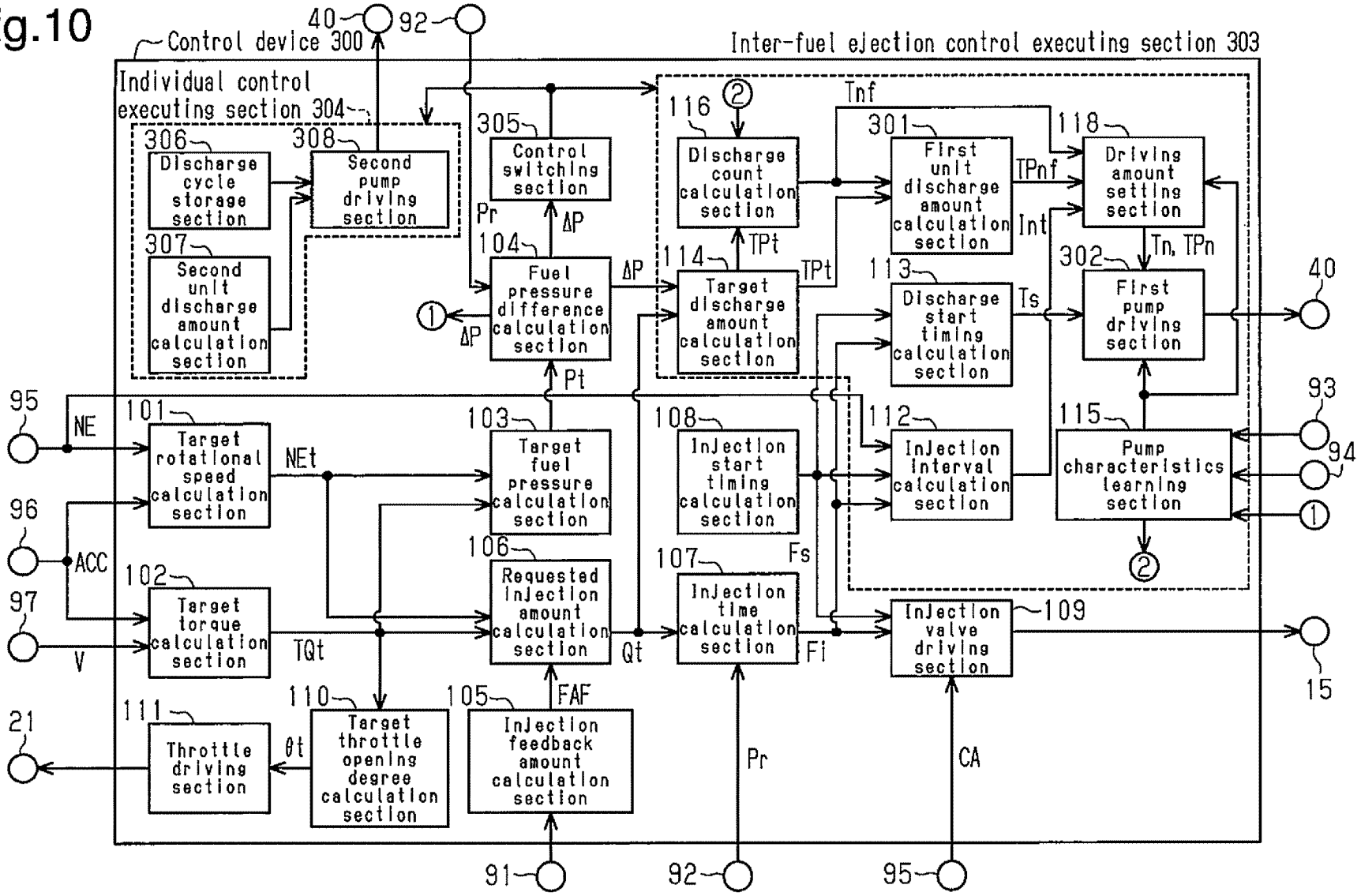
FIG. 10 is a functional block diagram of a control device for a fuel pump according to a third embodiment.
Figure 11:
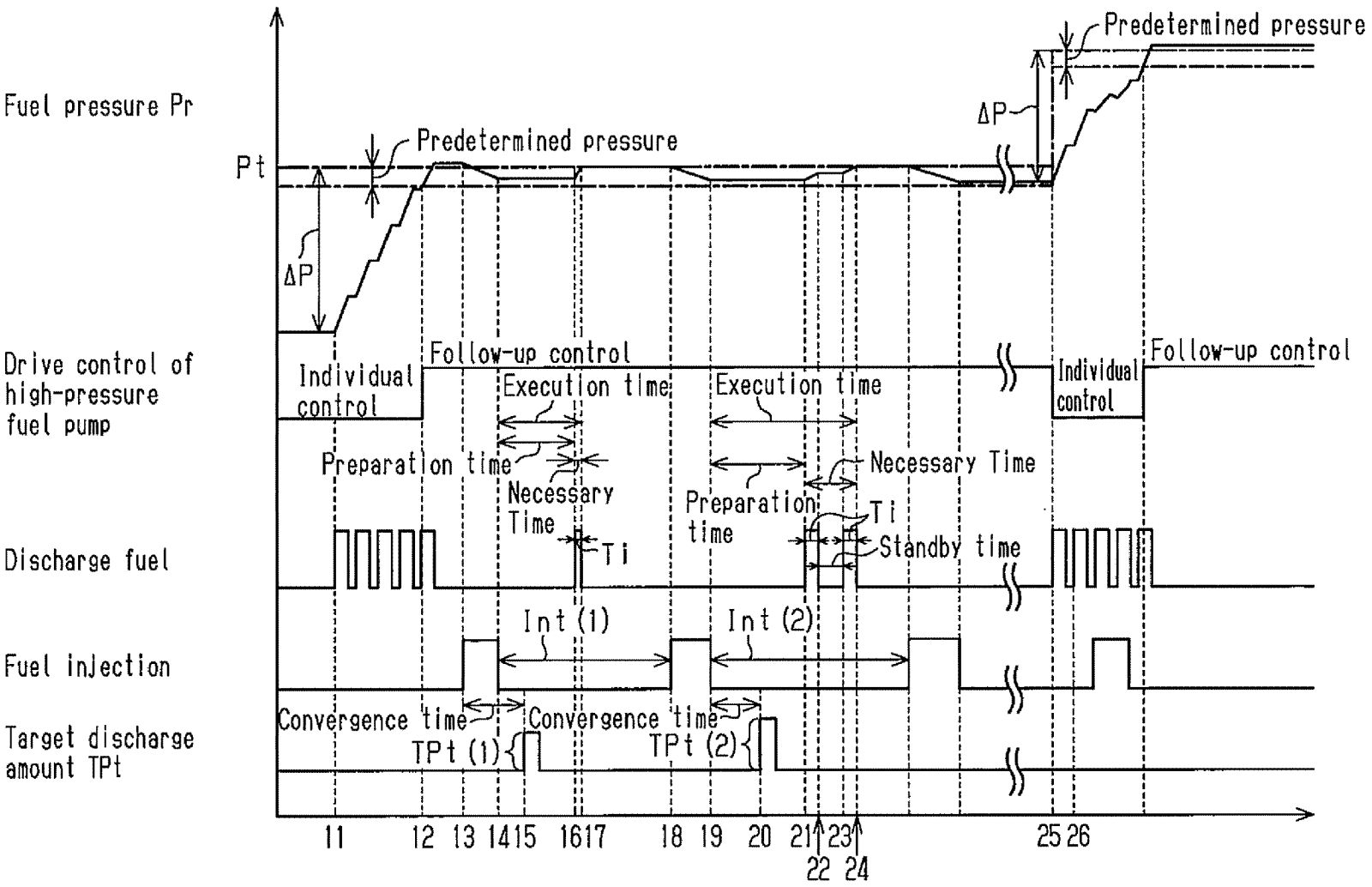
FIG. 11 is a timing diagram showing an example of a manner of fuel injection from the fuel injection valve and a manner of fuel discharge from the high-pressure fuel pump according to the third embodiment.

As shown in FIG. 10, a control device 300 for a fuel pump includes, as functional sections, a target rotational speed calculation section 101, a target torque calculation section 102, a target fuel pressure calculation section 103, a fuel pressure difference calculation section 104, an injection feedback amount calculation section 105, a required injection amount calculation section 106, an injection time calculation section 107, an injection start timing calculation section 108, and an injection valve driving section 109. Further, the control device 300 includes a target throttle opening degree calculation section 110, a throttle driving section 111, an injection interval calculation section 112, a discharge start timing calculation section 113, a target discharge amount calculation section 114, a pump characteristics learning section 115, a discharge count calculation section 116, a first unit discharge amount calculation section 301, a driving amount setting section 118, and a first pump driving section 302.

The target rotational speed calculation section 101, the target torque calculation section 102, the target fuel pressure calculation section 103, the fuel pressure difference calculation section 104, the injection feedback amount calculation section 105, the required injection amount calculation section 106, the injection time calculation section 107, the injection start timing calculation section 108, and the injection valve driving section 109 each have the same function as those in the first embodiment. Further, the target throttle opening degree calculation section 110, the throttle driving section 111, the injection interval calculation section 112, the discharge start timing calculation section 113, the target discharge amount calculation section 114, the pump characteristics learning section 115, the discharge count calculation section 116, and the driving amount setting section 118 each have the same function as those in the first embodiment.

The first unit discharge amount calculation section 301 has the same function as the unit discharge amount calculation section 117 in the first embodiment. Further, the first pump driving section 302 has the same function as the pump driving section 119 in the first embodiment.

The injection interval calculation section 112, the discharge start timing calculation section 113, the target discharge amount calculation section 114, the pump characteristics learning section 115, the discharge count calculation section 116, the first unit discharge amount calculation section 301, the driving amount setting section 118, and the first pump driving section 302 constitute an inter-injection discharge control executing section 303. The inter-injection discharge control executing section 303 executes an inter-injection discharge control of executing fuel discharge from the high-pressure fuel pump 40 to the high-pressure fuel pipe 34 at a predetermined point in time within a period between fuel injection from the fuel injection valve 15 and the next fuel injection.

The control device 300 also includes an individual control executing section 304 and a control switching section 305.

The individual control executing section 304 executes an individual control of repeatedly discharging fuel from the high-pressure fuel pump 40 in a fixed cycle. In the individual control, fuel discharge is performed irrespective of the timing of fuel injection from the fuel injection valve 15. The individual control executing section 304 includes a discharge cycle storage section 306, a second unit discharge amount calculation section 307, and a second pump driving section 308 as functional sections.

The discharge cycle storage section 306 stores an energization cycle that is a cycle of executing energization control for the high-pressure fuel pump 40. In the present embodiment, the energization cycle is a fixed cycle, and is previously obtained by experiment and simulation such that the cycle is shorter than the driving cycle of the high-pressure fuel pump 40 in the inter-injection discharge control, and the energization cycle is stored.

The second unit discharge amount calculation section 307 calculates a unit discharge amount TPn that is the amount of fuel discharged from the high-pressure fuel pump 40 per one time in the individual control. The second unit discharge amount calculation section 307 calculates the unit discharge amount TPn such that when the battery voltage is high, it becomes larger than when the battery voltage is low. In the present embodiment, the unit discharge amount TPn is set to the same amount as the maximum discharge amount TPmax.

The second pump driving section 308 drives the high-pressure fuel pump 40 by executing energization control for the high-pressure fuel pump 40 based on the unit discharge amount TPn calculated by the second unit discharge amount calculation section 307 and the energization cycle stored in the discharge cycle storage section 306, without taking into consideration the timing of fuel injection from the fuel injection valve 15.

When a start condition of the individual control is satisfied, the control switching section 305 switches the drive control for the high-pressure fuel pump 40 from the inter-fuel discharge control to the individual control. The start condition is set in the control switching section 305, and indicates that a fuel pressure difference ΔP calculated by the fuel pressure difference calculation section 104 is equal to or higher than a predetermined pressure. Specifically, when the fuel pressure difference ΔP is equal to or higher than the predetermined pressure, the drive control for the high-pressure fuel pump 40 is switched to the individual control. When the fuel pressure difference ΔP is lower than the predetermined pressure, the drive control for the high-pressure fuel pump 40 is switched to the inter-injection discharge control. The predetermined pressure is set to the same value as a fuel pressure difference ΔP for which a time (for example, several seconds) is required for the fuel pressure Pr to reach the target fuel pressure Pt when the inter-injection discharge control is executed. The predetermined pressure is previously obtained by experiment and simulation and stored in the control device 300.

An operation and advantages of the present embodiment will now be described with reference to FIG. 11. In the present embodiment, in particular, the following operation and advantages can be obtained. In FIG. 11, regarding a symbol t indicating the point in time of each operation and four-digit numbers following the symbol, the symbol t and the first two digits 11 of the four digits are omitted. In FIG. 11, a drive control for the fuel injection valve 15 and the high-pressure fuel pump 40 at the time of starting the internal combustion engine 10 will be described as an example.

At a point in time t1111 immediately after the start of the internal combustion engine 10, the fuel pressure Pr in the high-pressure fuel pipe 34 is low. Accordingly, the fuel pressure difference ΔP between the target fuel pressure Pt and the fuel pressure Pr, which is calculated at the time of starting the internal combustion engine 10, is equal to or higher than the predetermined pressure. For this reason, the control switching section 305 sets the drive control for the high-pressure fuel pump 40 to the individual control.

In the individual control, the second pump driving section 308 performs energization control in the energization cycle stored in the discharge cycle storage section 306 so that the unit discharge amount TPn becomes a unit discharge amount TPn calculated by the second unit discharge amount calculation section 307. Specifically, the second pump driving section 308 repeatedly executes fuel discharge from the high-pressure fuel pump 40 by using a lift time Ti corresponding to the unit discharge amount TPn at the point in time t1111. By the individual control, fuel is discharged from the high-pressure fuel pump 40 to the high-pressure fuel pipe 34 without taking into consideration the timing of fuel injection from the fuel injection valve 15.

Therefore, the fuel pressure Pr increases toward the target fuel pressure Pt at an early stage. Then, when the fuel pressure Pr reaches a pressure close to the target fuel pressure Pt, the control switching section 305 switches the drive control for the high-pressure fuel pump 40 from the individual control to the inter-injection discharge control at a point in time t1112 when the fuel pressure difference ΔP becomes lower than the predetermined pressure.

In the inter-injection discharge control, the high-pressure fuel pump 40 is driven as follows.

That is, after the start of the internal combustion engine 10, when the fuel pressure Pr reaches the target fuel pressure Pt, fuel injection from the fuel injection valve 15 is executed at a subsequent point in time t1113. By repeating this fuel injection, the fuel pressure Pr decreases.

The target discharge amount calculation section 114 calculates a target discharge amount TPt(1) at a point in time t1115 when the convergence time has elapsed from the end timing Fe (point in time t1114) of the fuel injection. The target discharge amount TPt(l) is calculated based on a required fuel injection amount Qt(l) for the fuel injection during the period between the point in time t1113 and the point in time t1114, and a discharge feedback amount TK calculated based on a fuel pressure difference ΔP.

When the target discharge amount TPt(l) is calculated in this way, the discharge count calculation section 116 calculates a necessary discharge count Tnf for the high-pressure fuel pump 40 to discharge fuel to the high-pressure fuel pipe 34. In this example, since the target discharge amount TPt(1) is less than the maximum discharge amount TPmax based on the operation characteristics of the high-pressure fuel pump 40, the necessary discharge count Tnf is calculated as one. Then, the first unit discharge amount calculation section 301 calculates the target discharge amount TPt(1) as a target unit discharge amount TPnf (TPnf=TPt(1)). When the necessary discharge count Tnf and the target unit discharge amount TPnf are calculated in this way, the driving amount setting section 118 sets a discharge count Tn of fuel for the period between the fuel injection from the fuel injection valve 15 and the next fuel injection, and a unit discharge amount TPn in each discharge.

The driving amount setting section 118 first calculates a necessary time Tnes (lift time Ti) required for performing fuel discharge by the target unit discharge amount TPnf set by the first unit discharge amount calculation section 301 as many times as the necessary discharge count Tnf, based on the operation characteristics of the high-pressure fuel pump 40 learned by the pump characteristics learning section 115. Then, the driving amount setting section 118 calculates a time obtained by adding the necessary time Tnes and the preparation time described above as an execution time Tad. Since the execution time Tad is equal to or less than an injection interval Int(1) calculated by the injection interval calculation section 112, the driving amount setting section 118 sets the discharge count Tn to the same number as the necessary discharge count Tnf, and sets the unit discharge amount TPn to be equal to the target unit discharge amount TPnf.

After that, the first pump driving section 302 drives the high-pressure fuel pump 40 so that fuel discharge is executed at a discharge start timing Ts calculated by the discharge start timing calculation section 113. In this case, the first pump driving section 302 performs fuel discharge once from the high-pressure fuel pump 40 to the high-pressure fuel pipe 34 at a point in time t1116 when the preparation time described above has elapsed from the point in time t1114, at which the fuel injection is ended. The fuel discharge is executed during the period between the point in time t1116 and a point in time t1117 when the lift time Ti corresponding to the target unit discharge amount TPnf has elapsed. Accordingly, fuel discharge from the high-pressure fuel pump 40 is performed at the discharge start timing Ts that is a predetermined point in time within the period between the end of the fuel injection from the fuel injection valve 15 and the start of the next fuel injection. By executing this fuel discharge, the fuel pressure Pr in the high-pressure fuel pipe 34 increases.

After that, at a point in time t1118, fuel injection from the fuel injection valve 15 is started. By executing the fuel injection, the fuel pressure Pr in the high-pressure fuel pipe 34 decreases. More fuel is injected in the fuel injection during the period between the point in time t1118 and a point in time t1119 than in the previous fuel injection during the period between the point in time t1113 and the point in time t1114. Therefore, at the point in time t1119, at which the fuel injection is ended, the fuel pressure is lowered than in the previous fuel injection. At the point in time t119, since the fuel pressure difference ΔP between the fuel pressure Pr and the target fuel pressure Pt is lower than the predetermined pressure, the inter-injection discharge control is continued.

The target discharge amount calculation section 114 calculates a target discharge amount TPt(2) at a point in time t1120 when the convergence time has elapsed from the end timing Fe (point in time t1119) of the fuel injection. The target discharge amount TPt(2) is calculated based on a required fuel injection amount Qt(2) for the subsequent injection and a discharge feedback amount TK calculated based on a fuel pressure difference ΔP. Since the required fuel injection amount Qt(2) is larger than the required fuel injection amount Qt(1), the target discharge amount TPt(2) is calculated as a value larger than the target discharge amount TPt(1).

When the target discharge amount TPt(2) is calculated, the discharge count calculation section 116 calculates a necessary discharge count Tnf. In this example, since the target discharge amount TPt(2) is equal to or larger than the maximum discharge amount TPmax based on the operation characteristics of the high-pressure fuel pump 40 and less than twice the maximum discharge amount TPmax, the necessary discharge count Tnf is calculated as two times. Then, the first unit discharge amount calculation section 301 calculates a value obtained by dividing the target discharge amount TPt(2) by 2 as the target unit discharge amount TPnf (TPnf=TPt(2)/2). When the necessary discharge count Tnf and the target unit discharge amount TPnf are calculated in this way, the driving amount setting section 118 sets a discharge count Tn for the period between the fuel injection from the fuel injection valve 15 and the next fuel injection, and a unit discharge amount TPn in each discharge.

The driving amount setting section 118 first calculates a necessary time Tnes (Tnes=2×lift time Ti+1×standby time) required for performing fuel discharge by the discharge amount TPnf set by the first unit discharge amount calculation section 301 as many times as the necessary discharge count Tnf, based on the operation characteristics of the high-pressure fuel pump 40 learned by the pump characteristics learning section 115. Then, the driving amount setting section 118 calculates a time obtained by adding the necessary time Tnes and the preparation time described above is calculated as an execution time Tad. Since the execution time Tad is equal to or less than an injection interval Int(2) calculated by the injection interval calculation section 112, the driving amount setting section 118 sets the discharge count Tn to the same number as the necessary discharge count Tnf, and sets the unit discharge amount TPn to be equal to the target unit discharge amount TPnf.

After that, the first pump driving section 302 drives the high-pressure fuel pump 40 so that fuel discharge is started at a discharge start timing Ts calculated by the discharge start timing calculation section 113. In this case, the first pump driving section 302 performs fuel discharge two times from the high-pressure fuel pump 40 to the high-pressure fuel pipe 34 at a point in time t1121 when the preparation time described above has elapsed from the point in time t1119, at which the fuel injection is ended. The first fuel discharge is executed during the period between the point in time t1121 and a point in time t1122 when the lift time Ti corresponding to the target unit discharge amount TPnf has elapsed. The first pump driving section 302 starts the second fuel discharge at a point in time t1123 when the standby time has elapsed from the point in time t1122, at which the first fuel discharge is ended. The second fuel discharge is executed during the period between the point in time t1123 and a point in time t1124 when the lift time Ti has elapsed. The first lift time and the second lift time are equal to each other. Accordingly, fuel discharge from the high-pressure fuel pump 40 is performed at the discharge start timing Ts that is a predetermined point in time within the period between the end of the fuel injection from the fuel injection valve 15 and the start of the next fuel injection.

When the operating state of the internal combustion engine changes at a point in time t1125 and the target fuel pressure Pt calculated by the target fuel pressure calculation section 103 increases, the fuel pressure difference ΔP between the target fuel pressure Pt and the fuel pressure Pr increases accordingly. In FIG. 11, as the target fuel pressure Pt increases, ΔP becomes equal to or higher than the predetermined pressure. For this reason, the control switching section 305 switches the drive control for the high-pressure fuel pump 40 from the inter-injection discharge control to the individual control. As a result, the second pump driving section 308 performs the energization control for the high-pressure fuel pump 40 until the fuel pressure Pr reaches a pressure close to the target fuel pressure Pt after the point in time t1125. As described above, in the individual control, the second pump driving section 308 performs the energization control for the high-pressure fuel pump 40 in the energization cycle stored in the discharge cycle storage section 306 so that the unit discharge amount TPn becomes the unit discharge amount TPn calculated by the second unit discharge amount calculation section 307. Thus, fuel discharge from the high-pressure fuel pump 40 is repeated irrespective of the timing of fuel injection from the fuel injection valve 15. The driving cycle of the high-pressure fuel pump 40 in the individual control is shorter than the driving cycle of the high-pressure fuel pump 40 in the inter-injection discharge control. In the inter-injection discharge control, the interval between the starts of the two fuel discharges (for example, the period of time between the point in time t1116 and the point in time t1121) that are executed via the timing of fuel injection from the fuel injection valve 15 is the driving cycle of the high-pressure fuel pump 40, while in the individual control, the interval between the starts of fuel discharges (for example, the period of time between the point in time t1125 and the point in time t1126) that are intermittently executed is the driving cycle of the high-pressure fuel pump 40. Accordingly, the fuel discharge interval in the individual control is shorter than the fuel discharge interval in the inter-injection discharge control. Therefore, in the individual control, the count of supplying fuel into the high-pressure fuel pipe 34 can be increased as compared to the inter-injection discharge control, and the fuel pressure Pr can be increased to the target fuel pressure Pt at an early stage.

In the present embodiment, in the individual control, the unit discharge amount TPn is made larger when the battery voltage is high than when the battery voltage is low. Therefore, when the fuel is repeatedly discharged at fixed intervals by the individual control, it is possible to drive the high-pressure fuel pump 40 with an appropriate discharge amount in consideration of the battery voltage.

The above-described embodiments may be modified as follows. The above-described embodiments and the following modifications can be combined as long as the combined modifications remain technically consistent with each other.

In the third embodiment, the control switching section 305 is configured to set the drive control of the high-pressure fuel pump 40 to individual control when the start condition indicating that the fuel pressure difference ΔP is equal to or higher than the predetermined pressure is satisfied. The start condition is not limited to this. For example, the start condition may include both the fuel pressure difference ΔP of equal to or higher than the predetermined pressure and the point in time at which the internal combustion engine 10 is started. In this case, the individual control is set when the fuel pressure difference ΔP is equal to or higher than the predetermined pressure and when the internal combustion engine 10 is started.

In addition, the control switching section 305 may be configured to set the individual control when the internal combustion engine 10 is started irrespective of whether or not the fuel pressure difference ΔP is equal to or higher than the predetermined pressure.

In the third embodiment, the example described above is that only one predetermined pressure is used as a determination value for determining switching of the drive control for the high-pressure fuel pump 40 in the control switching section 305. However, the manner in which the drive control is switched is not limited to this. That is, a determination value for determining switching from the inter-injection discharge control to the individual control and a determination value for determining switching from the individual control to the inter-injection discharge control may be different. In this case, for example, the control switching section 305 may be configured so that when the fuel pressure difference ΔP is equal to or higher than a first predetermined pressure, the drive control is switched from the inter-injection discharge control to the individual control; when the fuel pressure difference ΔP is lower than a second predetermined pressure that is lower than the first predetermined pressure, the drive control is switched from the individual control to the inter-injection discharge control.

In the third embodiment, the second unit discharge amount calculation section 307 is configured to calculate the unit discharge amount TPn for the individual control when the battery voltage is high such that it becomes larger than when the battery voltage is low. However, such a configuration may be omitted. That is, it is also possible to calculate a discharge amount that does not change depending on the battery voltage as the unit discharge amount TPn.

In each of the above-described embodiments, the target discharge amount calculation section 114 can also be configured to calculate the target discharge amount TPt based on parameters other than the required fuel injection amount Qt. For example, the target discharge amount calculation section 114 may calculate the target discharge amount TPt based on the engine rotational speed NE of the internal combustion engine 10 detected by the crank angle sensor 95, the load of the internal combustion engine 10, etc. Even with such a configuration, the target discharge amount TPt can be calculated based on the operating state of the internal combustion engine. In the case where the target discharge amount TPt is calculated based on the engine rotational speed NE of the internal combustion engine 10, the target discharge amount TPt can be calculated such that it becomes larger when the engine rotational speed NE is high than when the engine rotational speed NE is low. Further, in the case where the target discharge amount TPt is calculated based on the load of the internal combustion engine 10, the target discharge amount TPt can be calculated such that it becomes larger when the load is high than when the load is low.

Further, the target discharge amount calculation section 114 can appropriately change the point in time at which the target discharge amount TPt is calculated. For example, the target discharge amount calculation section 114 can calculate the target discharge amount TPt at the point in time at which the fuel injection is ended, without taking the convergence time into consideration.

In each of the above-described embodiments, the discharge count calculation section 116 can also be configured to calculate the necessary discharge count Tnf based on parameters other than the target discharge amount TPt. For example, the discharge count calculation section 116 can calculate the necessary discharge count Tnf based on the engine rotational speed NE of the internal combustion engine 10 detected by the crank angle sensor 95 or the load of the internal combustion engine 10. In the case where the necessary discharge count Tnf is calculated based on the engine rotational speed NE of the internal combustion engine 10, the necessary discharge count Tnf can be calculated such that it becomes larger when the engine rotational speed NE is high than when the engine rotational speed NE is low. Further, in the case where the necessary discharge count Tnf is calculated based on the load of the internal combustion engine 10, the necessary discharge count Tnf can be calculated such that it becomes larger when the load is high than when the load is low.

Further, the discharge count calculation section 116 may be configured to calculate a preset fixed number of times as the necessary discharge count Tnf, instead of calculating the necessary discharge count Tnf depending on the operating state of the internal combustion engine. With this configuration, as in the above-described embodiments, the upper limit of the execution time Tad is restricted by the injection interval Int of fuel in the fuel injection valve 15. Thus, the discharge count Tn of fuel and the unit discharge amount TPn are controlled based on the operating state of the internal combustion engine.

An example of a manner in which the discharge count Tn and the unit discharge amount TPn are set in the case where the necessary discharge count Tnf is calculated as a fixed number will be described below. In the following example, the necessary discharge count Tnf is set to three.

Figure 12:
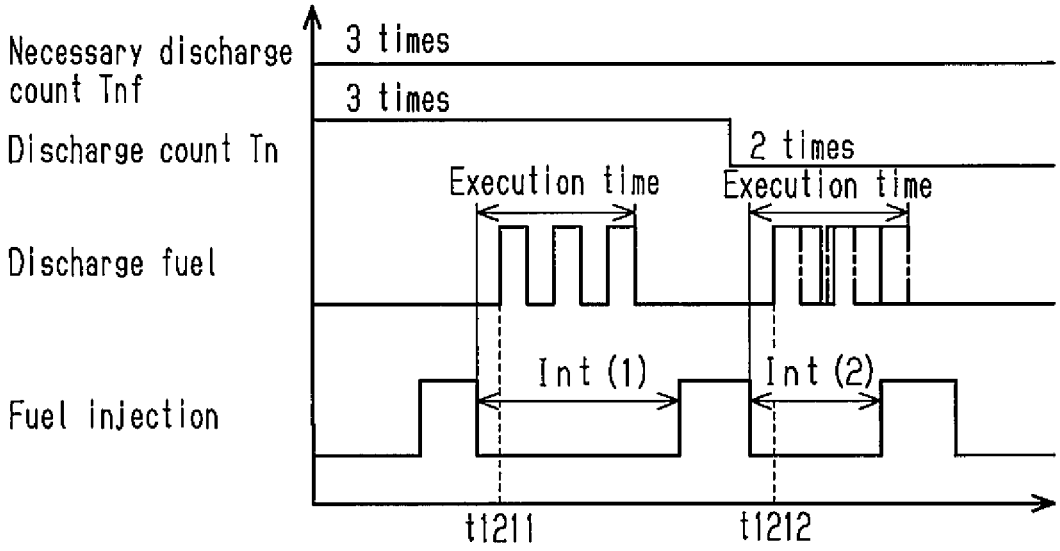
FIG. 12 is a timing diagram showing an example of a manner of fuel injection from the fuel injection valve and a manner of fuel discharge from the high-pressure fuel pump according to a modification.

As shown in FIG. 12, in the discharge count calculation section 116, the fixed number of times is set to three. In addition, in this example, the target discharge amount TPt is 1.5 times the maximum discharge amount TPmax, and the unit discharge amount TPn when fuel discharge is performed is set to half the maximum discharge amount TPmax (½× TPmax).

As shown in FIG. 12, the execution time Tad is shorter than an injection interval Int (1) of fuel in the fuel discharge started at a point in time t1211. Accordingly, the discharge count Tn is set to three, and fuel discharge is performed three times.

On the other hand, when the rotational speed of the internal combustion engine increases and an injection interval Int(2) becomes shorter than Int(1), as indicated by the long dashed double-short dashed lines in FIG. 12, the execution time Tad of the fuel discharge started at a point in time t1212 becomes longer than the injection interval Int(2) of fuel. In this case, the discharge count Tn and the unit discharge amount TPn are set based on the injection interval Int(2). In this example, the discharge count Tn is set to two times, and the unit discharge amount TPn is set to an amount of 0.75 times the maximum discharge amount TPmax. Then, fuel discharge is performed at the discharge count Tn and the unit discharge amount TPn that are calculated based on the injection interval Int(2). In this way, even when the necessary discharge count Tnf is a fixed number of times, the upper limit of the execution time Tad can be set by the injection interval Int that changes depending on the operating state of the internal combustion engine 10. Thus, the discharge count Tn and the unit discharge amount TPn are controlled based on the operating state of the internal combustion engine 10.

When the upper limit of the execution time Tad is set according to the injection interval Int of fuel in the fuel injection valve 15, fuel discharge may be executed with an amount smaller than the target discharge amount TPt. Accordingly, in each of the above-described embodiments, when a restricted upper limit of the execution time Tad causes the execution time Tad to continue to be equal to the injection interval Int of fuel for a predetermined time, a control manner may be adopted in which the individual control for executing fuel discharge is executed irrespective of the timing of fuel injection. In the case of adopting such a configuration, when the individual control is executed and the fuel pressure Pr increases accordingly, the individual control is switched to the inter-injection discharge control to perform fuel discharge based on the timing of fuel injection. With that configuration, even when a configuration to restrict the upper limit of the execution time Tad is adopted, it is possible to suppress a decrease in the fuel pressure Pr in the high-pressure fuel pipe 34.

Each of the above-described embodiments may be configured not to set the upper limit of the execution time Tad according to the injection interval Int of fuel in the fuel injection valve 15.

The operation characteristics of the high-pressure fuel pump 40 does not have to be necessarily learned.

In each of the above-described embodiments, the example in which the discharge count Tn is set to one or two has been described. However, it is obvious that the discharge count Tn may be set to three or more.

Each of the above-described embodiments does not limit the manner in which the unit discharge amount TPn is set when fuel discharge from the high-pressure fuel pump 40 to the high-pressure fuel pipe 34 is performed a plurality of times during a period between fuel injection from the fuel injection valve 15 and the next fuel injection. For example, the unit discharge amount TPn for the last fuel discharge among a plurality of times of fuel discharge may be set to be the same amount as the maximum discharge amount TPmax of the high-pressure fuel pump 40, and the unit discharge amount TPn for the other fuel discharges except for the last fuel discharge among the plurality of times of fuel discharge may be set to be smaller than the maximum discharge amount TPmax. Further, when three or more times of fuel discharge is performed during the period between fuel injection from the fuel injection valve 15 and the next fuel injection, the unit discharge amount TPn for the first and last fuel discharges among the plurality of times of fuel discharge may be set to be smaller than the maximum discharge amount TPmax of the high-pressure fuel pump 40, and the unit discharge amount TPn for the other fuel discharges except for the first and last fuel discharges among the plurality of times of fuel discharge may be set to be equal to the maximum discharge amount TPmax. In addition, among the plurality of times of fuel discharge, the unit discharge amount TPn for fuel discharge at a later point in time may be set to be smaller, or the unit discharge amount TPn for fuel discharge at a later point in time may be set to be larger. Further, the unit discharge amount TPn for each of the plurality of times of fuel discharge can be set to be smaller than the maximum discharge amount TPmax of the high-pressure fuel pump 40, and the respective unit discharge amounts TPn can be set to be different from each other.

Although the injection start timing calculation section 108 calculates a fixed point in time at which the predetermined crank angle before reaching the compression top dead center as the injection start timing Fs, the injection start timing Fs may be set depending on the operating state of the internal combustion engine 10, instead of the fixed timing. For example, the injection start timing calculation section 108 can calculate the injection start timing Fs, which is a point in time at which fuel injection from each fuel injection valve 15 is started, based on the required fuel injection amount Qt calculated by the required injection amount calculation section 106, the injection time Fi calculated by the injection time calculation section 107, and the engine rotational speed NE detected by the crank angle sensor 95. In this case, each injection start timing Fs in the fuel injection valve 15 can be calculated such that the fuel injection for the required fuel injection amount Qt is completed before the ignition time of the cylinder where the fuel injection valve 15 is disposed.

In each of the above-described embodiments, the discharge start timing calculation section 113 calculates a point in time at which the predetermined preparation time has elapsed from the end timing Fe of fuel injection as the discharge start timing Ts. Calculation of the discharge start timing Ts can be changed as appropriate. For example, a point in time at which the convergence time has elapsed from the end timing Fe of fuel injection may be calculated as the discharge start timing Ts. In this case, fuel discharge is executed at the same point in time as the point in time at which the target discharge amount calculation section 114 calculates the target discharge amount TPt. Further, in the configuration in which the target discharge amount TPt is calculated before the fuel injection end timing Fe, the fuel injection end timing Fe may be calculated as the discharge start timing Ts without taking into consideration the preparation time. In this case, the fuel discharge is started at the point in time at which the fuel injection is ended. Furthermore, the discharge start timing calculation section 113 can also calculate a point in time within a period of fuel injection between the start of the fuel injection to the end of the fuel injection as the discharge start timing Ts.

In each of the above-described embodiments, the injection interval Int is calculated as a period between the end of fuel injection and the start of the next fuel injection. Calculation of the injection interval Int is not limited to this. For example, a period between the start of fuel injection and the start of the next fuel injection, a period between the start of fuel injection and the end of the next fuel injection, or a period between the end of fuel injection to the end of the next fuel injection may be calculated as the injection interval Int.

In each of the above-described embodiments, the example in which the period between fuel injection and the next fuel injection from the fuel injection valve 15 is defined as a period between the end of the fuel injection and the start of the next fuel injection has been described. However, the period between fuel injection from the fuel injection valve 15 and the next fuel injection is not limited to that definition. That is, the period between fuel injection from the fuel injection valve 15 and the next fuel injection means a concept including a period between the end of fuel injection and the end of the next fuel injection, a period between the start of fuel injection and the start of the next fuel injection, and a period between the start of fuel injection and the end of the next fuel injection.

The fuel in the fuel tank 31 may be drawn in by the high-pressure fuel pump 40. In this case, the low-pressure fuel pump 32 and the low-pressure fuel pipe 33 can be omitted.

The configuration of the high-pressure fuel pump 40 can be changed as appropriate. For example, the plunger 75 may be composed of a round bar portion that is made of a material different from magnetic material and is inserted in the cylinder bore 57, and a magnetic portion that is connected to one end of the round bar portion and is made of a magnetic material. Furthermore, a configuration may be provided in which the plunger 75 is displaced by moving the magnetic portion by a magnetic field generated by energizing the coil 85 so that the volume of the pressurizing chamber 78 is changed. Further, a configuration may be provided in which the plunger 75 does not have the protrusion 75B. In other words, as long as the fuel pump can reciprocate the plunger 75 by energization and has a suction function of drawing in fuel by reciprocating the plunger 75 and a discharge function of pressurizing and discharging the drawn fuel, the same control device as that in each of the above-described embodiments can be adapted for the fuel pump.

The control devices 100 and 300 for a fuel pump have a function of controlling the driving of the fuel injection valve 15 and a function of controlling the driving of the throttle valve 21. These functions may be included in a control section different from the control devices 100 and 300 for the fuel pump. In this case, each of the control devices 100 and 300 may be configured to communicate with the control section to transmit and receive necessary information to and from each other so that the driving of the fuel pump is controlled in the same manner as in each of the above-described embodiments.

The control device is not limited to a device that includes a CPU, a ROM, and a RAM and executes software processing. For example, a dedicated hardware circuit (such as an ASIC) may be provided that executes at least part of the software processes executed in each of the above-described embodiments. That is, the controller may be modified as long as it has any one of the following configurations (a) to (c). (a) A configuration including a processor that executes all of the above-described processes according to programs and a program storage device such as a ROM that stores the programs. (b) A configuration including a processor and a program storage device that execute part of the above-described processes according to the programs and a dedicated hardware circuit that executes the remaining processes. (c) A configuration including a dedicated hardware circuit that executes all of the above-described processes. A plurality of software processing circuits each including a processor and a program storage device and a plurality of dedicated hardware circuits may be provided. That is, the above processes may be executed in any manner as long as the processes are executed by processing circuitry that includes at least one of a set of one or more software processing circuits and a set of one or more dedicated hardware circuits.

The invention claimed is:

1. A control device for a motor-driven fuel pump adapted for an internal combustion engine, the internal combustion engine including a fuel injection valve configured to inject fuel into a cylinder, the fuel pump being configured to supply fuel to a fuel pipe connected to the fuel injection valve, the fuel pump including (i) a cylinder, (ii) a mover configured to slide in the cylinder, and (iii) an electric actuator configured to move the mover, the control device comprising processing circuitry configured to:

control energization of the electric actuator so as to reciprocate the mover so that the fuel pump draws in and discharges fuel;

control a discharge count and a unit discharge amount based on an operating state of the internal combustion engine, the discharge count being a number of fuel discharge operations of the fuel pump to the fuel pipe during a period between a first fuel injection from the fuel injection valve and a second subsequent fuel injection, and the unit discharge amount being an amount of fuel of one fuel discharge operation from the fuel pump;

set the discharge count to one when a target discharge amount is less than a specified amount, the target discharge amount being a target value of discharge amount of fuel from the fuel pump to the fuel pipe; and set the discharge count to two or more when the target discharge amount is equal to or greater than the specified amount.

2. The control device for a fuel pump according to claim 1, wherein the processing circuitry is configured to, upon the discharge count being set to two or more, set each unit discharge amount for a plurality of fuel discharge operations including the one fuel discharge operation to be smaller than a maximum discharge amount, the maximum discharge amount being a maximum value of the unit discharge amount to be discharged from the fuel pump in the one fuel discharge operation of the plurality of fuel discharge operations.

3. The control device for a fuel pump according to claim 1, wherein the processing circuitry is configured to, upon the discharge count being set to two or more, set each unit discharge amount for each fuel discharge operation of a plurality of fuel discharge operations including the one fuel discharge operation to be equal.

4. The control device for a fuel pump according to claim 1, wherein the processing circuitry is configured to, upon the discharge count being set to two or more, set each unit discharge amount for a secondary and subsequent fuel discharge operation of a plurality of discharge operations including the one discharge operation to be smaller than the unit discharge amount of the one fuel discharge operation.

5. The control device for a fuel pump according to claim 1, wherein the processing circuitry is configured to calculate the unit discharge amount based on a plurality of operation characteristics of the fuel pump under the energization control.

6. The control device for a fuel pump according to claim 1, wherein the processing circuitry is configured to:

set an execution time that is a time required for the fuel pump to complete a fuel discharge operation based on the discharge count, the unit discharge amount, and a plurality of operation characteristics of the fuel pump, and reduce an upper limit of the execution time in response to a diminishing injection interval, the injection interval being a period of time between the first fuel injection from the fuel injection valve and the second subsequent fuel injection.

7. The control device for a fuel pump according to claim 1, wherein the processing circuitry is configured to execute an individual control of a plurality of repeating discharging fuel operations of the fuel pump in a fixed cycle when a start condition is satisfied, the start condition including a condition that a difference between an actual value of fuel pressure in the fuel pipe and a target value of fuel pressure in the fuel pipe is equal to or higher than a predetermined pressure value.

8. The control device for a fuel pump according to claim 7, wherein the processing circuitry is configured to, during executing the individual control, set the unit discharge amount to be greater in response to an increase in a voltage of a battery for supplying electric power to the electric actuator.

9. A control method for a motor-driven fuel pump adapted for an internal combustion engine, the internal combustion engine including a fuel injection valve configured to inject fuel into a cylinder, the fuel pump being configured to supply fuel to a fuel pipe connected to the fuel injection valve, the fuel pump including (i) a cylinder, (ii) a mover configured to slide in the cylinder, and (iii) an electric actuator configured to move the mover, the control method comprising:

controlling energization of the electric actuator so as to reciprocate the mover so that the fuel pump draws in and discharges fuel;

controlling a discharge count and a unit discharge amount based on an operating state of the internal combustion engine, the discharge count being a number of fuel discharge operations of the fuel pump to the fuel pipe during a period between a first fuel injection from the fuel injection valve and a second subsequent fuel injection, and the unit discharge amount being an amount of fuel of one fuel discharge operation from the fuel pump;

setting the discharge count to one when a target discharge amount is less than a specified amount, the target discharge amount being a target value of discharge amount of fuel from the fuel pump to the fuel pipe; and setting the discharge count to two or more when the target discharge amount is equal to or greater than the specified amount.

10. A control device for a motor-driven fuel pump adapted for an internal combustion engine, the internal combustion engine including a fuel injection valve configured to inject fuel into a cylinder, the fuel pump being configured to supply fuel to a fuel pipe connected to the fuel injection valve, the fuel pump including (i) a cylinder, (ii) a mover configured to slide in the cylinder, and (iii) an electric actuator configured to move the mover, the control device comprising processing circuitry configured to:

control energization of the electric actuator so as to reciprocate the mover so that the fuel pump draws in and discharges fuel;

control a discharge count and a unit discharge amount based on an operating state of the internal combustion engine, the discharge count being a number of fuel discharge operations of the fuel pump to the fuel pipe during a period between a first fuel injection from the fuel injection valve and a second subsequent fuel injection, and the unit discharge amount being an amount of fuel of one fuel discharge operation from the fuel pump; and control the fuel pump to discharge fuel only within the period between the first fuel injection from the fuel injection valve and the second subsequent fuel injection in response to a difference between an actual value of fuel pressure in the fuel pipe and a target value of fuel pressure in the fuel pipe being less than a predetermined pressure.

* * * * *